US011346584B2

(12) United States Patent
Kozasa

(10) Patent No.: US 11,346,584 B2
(45) Date of Patent: May 31, 2022

(54) REFRIGERANT EVAPORATOR AND METHOD FOR MANUFACTURING SAME

(71) Applicant: DENSO CORPORATION, Kariya (JP)

(72) Inventor: Tetsuo Kozasa, Kariya (JP)

(73) Assignee: DENSO CORPORATION, Kariya (JP)

( * ) Notice: Subject to any disclaimer, the term of this patent is extended or adjusted under 35 U.S.C. 154(b) by 152 days.

(21) Appl. No.: 16/654,086

(22) Filed: Oct. 16, 2019

(65) Prior Publication Data

US 2020/0049382 A1 Feb. 13, 2020

Related U.S. Application Data

(63) Continuation of application No. PCT/JP2018/015659, filed on Apr. 16, 2018.

(30) Foreign Application Priority Data

May 10, 2017 (JP) ..... JP2017-094153

(51) Int. Cl.
*F25B 41/00* (2021.01)
*F25B 5/04* (2006.01)
*F25B 39/02* (2006.01)

(52) U.S. Cl.
CPC ..... *F25B 5/04* (2013.01); *F25B 39/024* (2013.01); *F25B 39/028* (2013.01)

(58) Field of Classification Search
CPC ..... F28D 1/05391; F28D 1/0417; F28D 2021/0085; F25B 5/04; F25B 39/02; F25B 39/024; F25B 39/028; F28F 1/022; F28F 1/126; F28F 17/005; F28F 9/0217; F28F 2009/224
USPC ..... 62/513
See application file for complete search history.

(56) References Cited

U.S. PATENT DOCUMENTS 9,625,214 B2 * 4/2017 Katoh ..... B60H 1/00342
2004/0206490 A1 * 10/2004 Katoh ..... F28F 9/22 165/174
2005/0006073 A1 1/2005 Demuth et al.
2005/0039901 A1 2/2005 Demuth et al.
(Continued)

FOREIGN PATENT DOCUMENTS

DE 4446817 C2 4/2003
JP 2004163036 A 6/2004
(Continued)

*Primary Examiner* — Henry T Crenshaw
*Assistant Examiner* — Kamran Tavakoldavani
(74) *Attorney, Agent, or Firm* — Harness, Dickey & Pierce, P.L.C.

(57) ABSTRACT

A refrigerant evaporator includes a first core, a second core, a first plate, and a second plate. The first core and the second core respectively include a plurality of first tubes and a plurality of second tubes extending along a tube longitudinal direction and stacked along a tube stacking direction. The first plate houses one end portions of the first tubes and the second tubes. The second plate faces the first core and the second core across the first plate and is joined to the first plate in the tube longitudinal direction. The second plate includes a plurality of ribs. The ribs and the first plate define a plurality of intermediate passageways therein. Each of the intermediate passageways allows communication between a corresponding one of the first tubes and a corresponding one of the second tubes.

13 Claims, 16 Drawing Sheets

(56) References Cited

U.S. PATENT DOCUMENTS

| | | | | |
|---|---|---|---|---|
| 2005/0103486 | A1* | 5/2005 | Demuth | F28D 1/05391 165/174 |
| 2005/0217838 | A1 | 10/2005 | Katoh et al. | |
| 2009/0126920 | A1 | 5/2009 | Demuth et al. | |
| 2009/0166017 | A1* | 7/2009 | Katoh | F28F 9/001 165/153 |
| 2011/0240271 | A1 | 10/2011 | Mross et al. | |

FOREIGN PATENT DOCUMENTS

| | | | |
|---|---|---|---|
| JP | 2005513403 | A | 5/2005 |
| JP | 2005283018 | A | 10/2005 |
| JP | 2007057176 | A | 3/2007 |
| JP | 2008025956 | A | 2/2008 |
| JP | 4124136 | B2 | 7/2008 |
| JP | 2009014282 | A | 1/2009 |
| JP | 2009275956 | A | 11/2009 |
| JP | 2011214827 | A | 10/2011 |
| JP | 2016130612 | A | 7/2016 |
| WO | WO-2015/189990 | A1 | 12/2015 |

* cited by examiner

REFRIGERANT EVAPORATOR AND METHOD FOR MANUFACTURING SAME

CROSS REFERENCE TO RELATED APPLICATIONS

This application is a continuation application of international Patent Application No. PCT/JP2018/015659 filed on Apr. 16, 2018, which designated the U.S. and claims the benefit of priority from Japanese Patent Application No. 2017-094153 filed on May 10, 2017. The entire disclosure of all of the above applications are incorporated herein by reference.

TECHNICAL FIELD

The present disclosure relates to a refrigerant evaporator that cools a cooling target fluid and a method for manufacturing the refrigerant evaporator.

BACKGROUND ART

Various types of conventional refrigerant evaporators for use in a refrigerating cycle of an air conditioning device have been proposed. Such refrigerant evaporators include at least two heat-exchange cores and an intermediate tank for collecting refrigerant from one of the heat-exchange cores and distributing refrigerant to the other one of the heat-exchange cores.

SUMMARY OF THE INVENTION

One aspect of the present disclosure is a refrigerant evaporator for heat exchange between fluid and refrigerant. The refrigerant evaporator includes a first evaporation unit, a second evaporation unit, a first core, a second core, a first plate, and a second plate. The first evaporation unit is configured to allow the fluid to flow therethrough in a flow direction. The second evaporation unit is configured to allow the fluid to flow therethrough in the flow direction. The second evaporation unit arranged in series with the first evaporation unit in the flow direction. The first core is included in the first evaporation unit and having a plurality of first tubes extending along a tube longitudinal direction perpendicular to the flow direction and stacked in a tube stacking direction perpendicular to both the flow direction and the tube longitudinal direction. The plurality of first tubes are configured to allow the refrigerant to flow therethrough. The second core is included in the second evaporation unit and having a plurality of second tubes extending along the tube longitudinal direction and stacked in the tube stacking direction, the second tubes being configured to allow the refrigerant to flow therethrough. The first plate is disposed on one side of the first and second cores in the tube longitudinal direction to be connected to one end portion of the first core and one end portion of the second core. The first plate houses one end portions of the first tubes and one end portions of the second tubes. The second plate faces the first core and the second core across the first plate and joined to the first plate in the tube longitudinal direction. The second plate includes a plurality of ribs protruding from the second plate along the tube longitudinal direction away from the first core and the second core and extending along the flow direction. The plurality of ribs define, together with the first plate, a plurality of intermediate passageways therein. Each of the plurality of first tubes is arranged to overlap with a respective one of the plurality of second tubes when viewed along the flow direction to form a pair of tubes facing each other along the flow direction. The pair of tubes are in fluid communication with each other through a corresponding one of the plurality of intermediate passageways.

DESCRIPTION OF EMBODIMENTS

Figure 1:
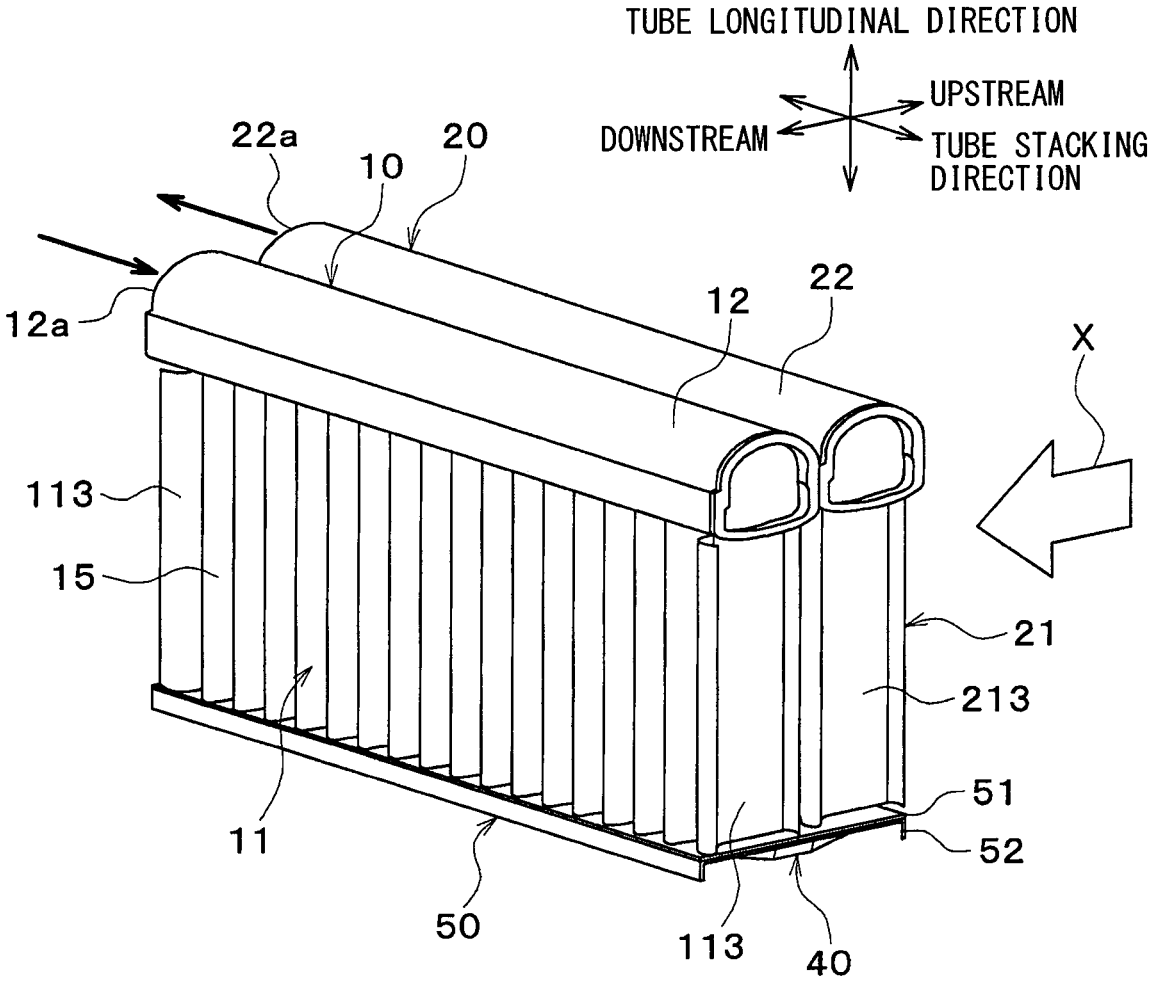
FIG. 1 is a perspective view of a refrigerant evaporator according to a first embodiment.

Some embodiments of the present disclosure are described below with reference to the drawings. In the following embodiments, identical or equivalent constituent elements are designated with identical symbols.

A refrigerant evaporator has multiple tubes through which refrigerant flows and which are placed in and joined to the intermediate tank of such refrigerant evaporators, thus increasing the internal volume of the intermediate tank. The refrigerant sectional area thus increases rapidly when refrigerant flows into the intermediate tank from the tubes of the one of the heat-exchange cores. The refrigerant sectional area decreases rapidly when refrigerant flows out from the intermediate tank into the other one of the heat-exchange cores.

Pressure loss thus increases at a refrigerant inflow portion from the tubes to the intermediate tank and at a refrigerant outflow portion from the intermediate tank to the tubes, especially in summer and other periods when the cooling thermal load increases, raising the refrigerant flow rate. The cooling performance of the air conditioning device may be thus degraded.

The intermediate tank has a substantially identical internal sectional area in a refrigerant flow direction (in a longitudinal direction of the intermediate tank), thus involving change in flow velocity of refrigerant in the process of collecting refrigerant from the tubes and in the process of distributing refrigerant to the tubes. The change in flow velocity of refrigerant causes change in static pressure applied to the inner wall surface of the intermediate tank in a manner dependent on the location in the longitudinal direction, leading to difference between pressures applied to the inlet and outlet of the tubes. The refrigerant distribution may be thus degraded.

To provide a solution, some refrigerant evaporators include two heat-exchange cores arranged in series with an airflow direction. The two heat-exchanger cores each include tubes that are arranged in a coincided manner when viewed from the airflow direction and are connected together by intermediate passageways.

Such intermediate passageways are configured by stacking three plate members, namely, a first plate member, a second plate member, and a third plate member. Specifically, the first plate member has tube insertion holes in which ends of the tubes are placed. The second plate member has through holes that communicate respectively with the tube insertion holes. The third plate member has a flat plate shape having no through holes. When these three plate members are stacked together, the through holes in the second plate member define the intermediate passageways.

In the refrigerant evaporator described above, a first heat-exchange core and a second heat-exchange core can be connected together by every pair of tubes that are arranged in the coincided manner when viewed from the airflow direction. An intermediate tank for collecting and distributing refrigerant from/to multiple tubes can be thus eliminated, which thereby lessens the probability of increasing pressure loss and degrading refrigerant distribution.

The refrigerant evaporator described above, however, may lead to an increased number of constituent elements because the intermediate tank is configured by using three plate members.

In view of the above, in a refrigerant evaporator that includes at least two cores, the following embodiments are presented to inhibit increase of constituent elements in number, inhibit increase of pressure loss at a connection portion between the two cores, and inhibit degradation in refrigerant distribution to tubes downstream of the connection portion.

In one embodiment, the intermediate passageways located on the one side of the tube longitudinal direction thus allow communication between the tubes in the respective pairs. That is, one of the intermediate passageways can connect a corresponding one of the first tubes to a corresponding one of the second tubes. An intermediate tank having a large internal volume for distribution or collection of refrigerant for the tubes can be thus eliminated. Each of the intermediate passageways, which is a connection portion between a corresponding one of the first tubes and a corresponding one of the second tubes, inhibits the refrigerant passageways internally disposed in the corresponding one of the first tubes and the corresponding one of the second tubes from becoming larger or smaller rapidly, thereby capable of reducing the difference between the refrigerant flow velocity in the intermediate passageway and that in the corresponding one of the first tubes and the difference between the refrigerant flow velocity in the intermediate passageway and that in the corresponding one of the second tubes. Increase of pressure loss in the intermediate passageways and degradation of refrigerant distribution to the second tubes can be thus inhibited. The intermediate passageways are configured by using the first plate and the second plate; thus, the constituent elements can be inhibited from increasing in number.

First Embodiment

A first embodiment of the present disclosure is described below with reference to FIGS. 1 to 10. A refrigerant evaporator according to the present embodiment is for use in a vapor compression type refrigerating cycle in a vehicle air conditioning device for regulating the temperature in a cabin of a vehicle. The refrigerant evaporator is a cooling heat exchanger that cools air by absorbing heat from air to be emitted into the cabin (blown air) and vaporizing a refrigerant (liquid-phase refrigerant).

Figure 2:
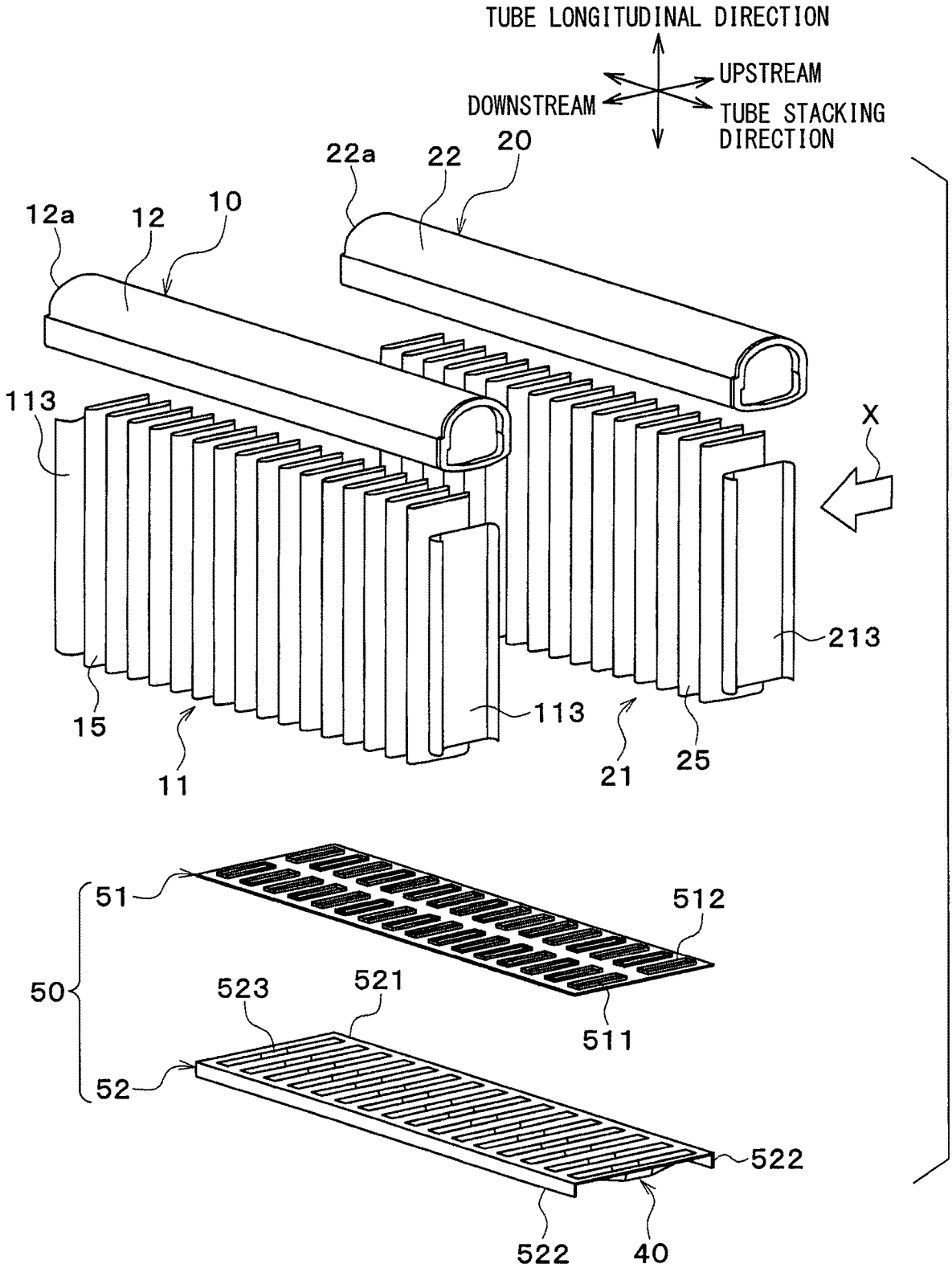
FIG. 2 is an exploded perspective view of FIG. 1.

In the present embodiment, air corresponds to "fluid-to-be-cooled". In FIGS. 1 and 2, illustration of fins 30, which is described below, is omitted.

The refrigerating cycle includes a compressor (not shown), a heat dissipating device (condenser) (not shown), and an expansion valve (not shown), in addition to a refrigerant evaporator 1, as widely known. In the present embodiment, the refrigerating cycle is configured as a receiver cycle that includes a receiver between the heat dissipating device and the expansion valve. The refrigerant in the refrigerating cycle is mixed with a refrigerating machine oil for lubricating the compressor, and a portion of the refrigerating machine oil is circulated in the cycle together with the refrigerant.

As illustrated in FIGS. 1 and 2, the refrigerant evaporator 1 according to the present embodiment includes a first evaporation unit 10 and a second evaporation unit 20 that are arranged in series in an airflow direction (the direction in which the fluid-to-be-cooled flows) X. In the present embodiment, the first evaporation unit 10 is disposed downstream (the lee side) of the second evaporation unit 20 in the airflow direction X.

The first evaporation unit 10 and the second evaporation unit 20 have the same basic configuration and include heat-exchange cores 11 and 21 and tanks 12 and 22, respectively. The tanks 12 and 22 are placed on upper portions of the heat-exchange cores 11 and 21, respectively.

In the present embodiment, the heat-exchange core in the first evaporation unit 10 may be referred to as the first core 11, and the heat-exchange core in the second evaporation unit 20 may be referred to as the second core 21. The tank in the first evaporation unit 10 may be referred to as the first tank 12, and the tank in the second evaporation unit 20 may be referred to as the second tank 22.

The first core 11 is configured using a stack of tubes 15 and fins 30 (see FIG. 3) disposed alternately, the tubes 15 extending in an up-and-down direction, the fins 30 joined to adjacent ones of the tubes 15. The second core 21 is configured using a stack of tubes 25 and the fins 30 disposed alternately, the tubes 25 extending in the up-and-down direction, and the fins 30 joined to adjacent ones of the tubes 25.

A stacking direction of the stack of the tubes 15 and the fins 30 and that of the tubes 25 and the fins 30 is hereinafter referred to as a tube stacking direction. The tubes configuring the first core 11 may be referred to as first tubes 15, and the tubes configuring the second core 21 may be referred to as second tubes 25. A longitudinal direction of the first tubes 15 and the second tubes 25 is referred to as a tube longitudinal direction. In the present embodiment, the first tubes 15 have similar configurations; thus, the wording, the first tube 15, may cover all the multiple first tubes 15 in the description below. The second tubes 25 have similar configurations; thus, the wording, the second tube 25, may cover all the multiple second tubes 25 in the description below.

The first tube 15 defines therein a refrigerant passageway through which refrigerant flows. The second tube 25 defines therein a refrigerant passageway through which refrigerant flows. The first tube 15 includes a flat tube having a flat sectional shape extending along the airflow direction X. The second tube 25 includes a flat tube having a flat sectional shape extending along the airflow direction X.

The first tube 15 and the second tube 25 are arranged to overlap with each other when viewed along the airflow direction X. The first tube 15 and the second tube 25 that is arranged to overlap with the first tube 15 when viewed along the airflow direction X may be hereinafter referred to as a pair of tubes 15 and 25. The refrigerant evaporator 1 includes multiple pairs of tubes 15 and 25.

An intermediate passageway 40 is provided on one end side of the pair of tubes 15 and 25 in the tube longitudinal direction for communication between the pair of tubes 15 and 25. In the present embodiment, the intermediate passageway 40 is placed on a lower end side of the pair of tubes 15 and 25. A plurality of intermediate passageways 40 is thus placed downward of the first core 11 and the second core 21. The intermediate passageways 40 are arranged in the tube stacking direction. The intermediate passageways 40 are described in detail below.

The first tube 15 is connected to the first tank 12 at the other end of the first tube 15 in the tube longitudinal direction (i.e., an upper end). The second tube 25 is connected to the second tank 22 at the other end in the tube longitudinal direction (i.e., an upper end).

Figure 3:
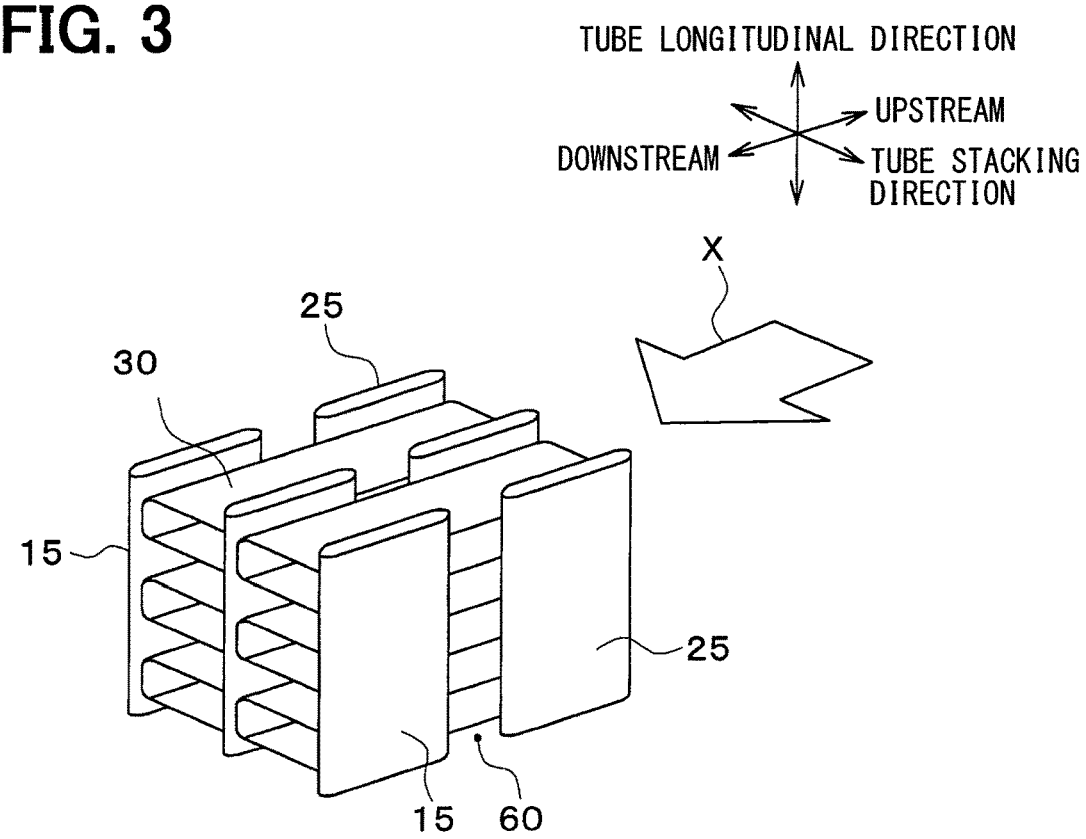
FIG. 3 is an enlarged perspective view of portions of a first core and a second core according to the first embodiment.

As illustrated in FIG. 3, the fin 30 is a corrugated fin formed by bending a thin plate material into a wave shape. The fin 30 is joined to flat outer surfaces of the first tube 15 and second tube 25, serving as a heat-exchange facilitator that provides an enlarged area for heat transfer between air and the refrigerant. In the present embodiment, the fin 30 is joined to both of the pair of tubes 15 and 25.

With reference back to FIGS. 1 and 2, side plates 113 are disposed on both end portions in the tube stacking direction of the stack of the first tubes 15 and the fins 30 for reinforcing the core 11. Side plates 213 are disposed on both end portions in the tube stacking direction of the stack of the second tubes 25 and the fins 30 for reinforcing the core 22. The side plates 113 and 213 are joined to outermost ones of the fins 30 in the tube stacking direction, respectively.

The first tank 12 is configured using a member having a tubular shape with one end portion in the tube stacking direction closed and the other end portion in the tube stacking direction including a refrigerant inlet 12*a*. The refrigerant inlet 12*a* introduces into the first tank 12 refrigerant having a lowered pressure resulting from pressure reduction at the expansion valve (not shown). In the present embodiment, a left end portion of the first tank 12 as viewed from upstream with respect to the airflow is closed, and a right end portion of the first tank 12 as viewed from upstream with respect to the airflow includes the refrigerant inlet 12*a*.

The first tank 12 has a bottom portion having through hole portions (not shown). The other end portions in the tube longitudinal direction (i.e., upper end portions) of the first tubes 15 are placed in and joined to the through hole portions. The first tank 12 has an internal space that permits communication with the first tubes 15 of the first core 11. The first tank 12 functions as a refrigerant distributor that distributes refrigerant to the first core 11.

The second tank 22 is configured using a member having a tubular shape with one end portion in the tube stacking direction closed and the other end portion in the tube stacking direction including a refrigerant outlet 22*a*. The refrigerant outlet 22*a* emits refrigerant from the second tank 22 toward an inlet of the compressor (not shown). In the present embodiment, a left end portion of the second tank 22 as viewed from upstream with respect to the airflow is closed, and a right end portion of the second tank 22 as viewed from upstream with respect to the airflow includes the refrigerant outlet 22*a*.

The second tank 22 has a bottom portion having through hole portions (not shown). The other end portions in the tube longitudinal direction (i.e., upper end portions) of the second tubes 25 are placed in and joined to the through hole portions. The second tank 22 has an internal space that permits communication with the second tubes 25 of the second core 21. The second tank 22 functions as a refrigerant collector that collects refrigerant from the second core 21.

Figure 4:
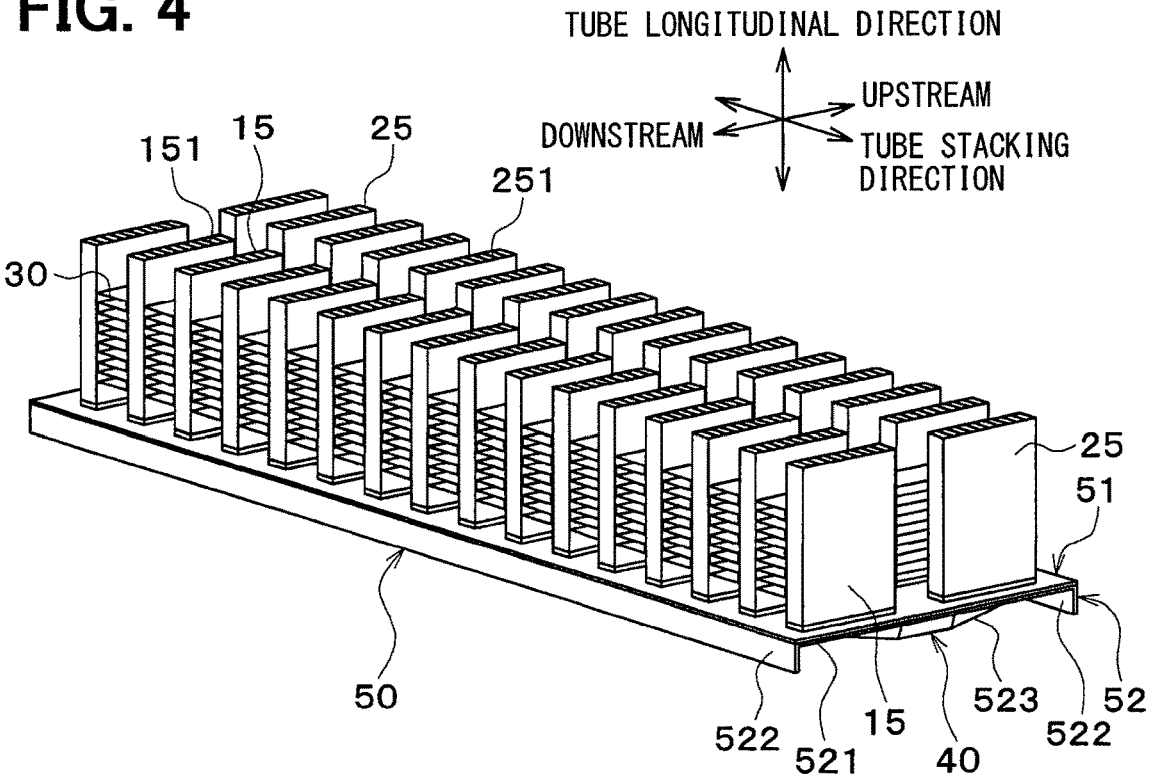
FIG. 4 is an enlarged perspective view of an intermediate tank and its vicinity in the first embodiment.

As illustrated in FIG. 4, an intermediate tank 50 is placed on one end side in the tube longitudinal direction (lower end side) of the first core 11 and the second core 21.

The intermediate tank 50 is a passageway-forming member that provides the intermediate passageways 40. The intermediate tank 50 is configured by combining a first plate 51 and a second plate 52.

Figure 5:
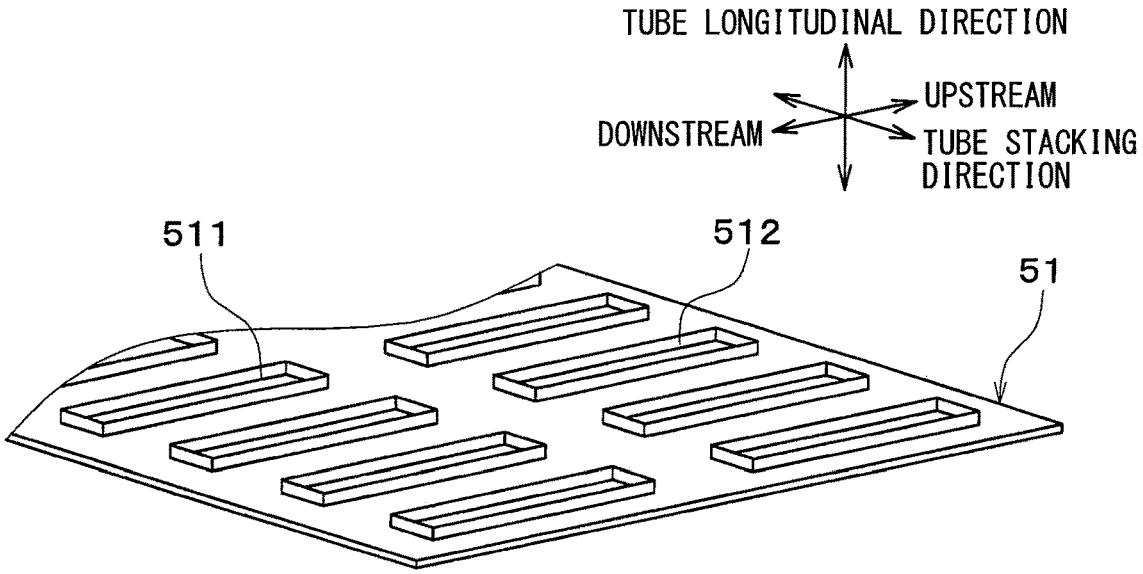
FIG. 5 is an enlarged perspective view of a first plate according to the first embodiment.

As illustrated in FIG. 5, the first plate 51 has a substantially rectangular plate shape. The first plate 51 is joined to one end portions in the tube longitudinal direction (i.e., lower end portions) of the first tubes 15 and the second tubes 25. Specifically, the first plate 51 has first insertion holes 511 in which the one end portions in the tube longitudinal direction of the first tubes 15 are placed. The first plate 51 also has second insertion holes 512 in which the one end portions in the tube longitudinal direction of the second tubes 25 are placed. The first insertion holes 511 and the second insertion holes 512 are formed by burring on the first plate 51.

Figure 6:
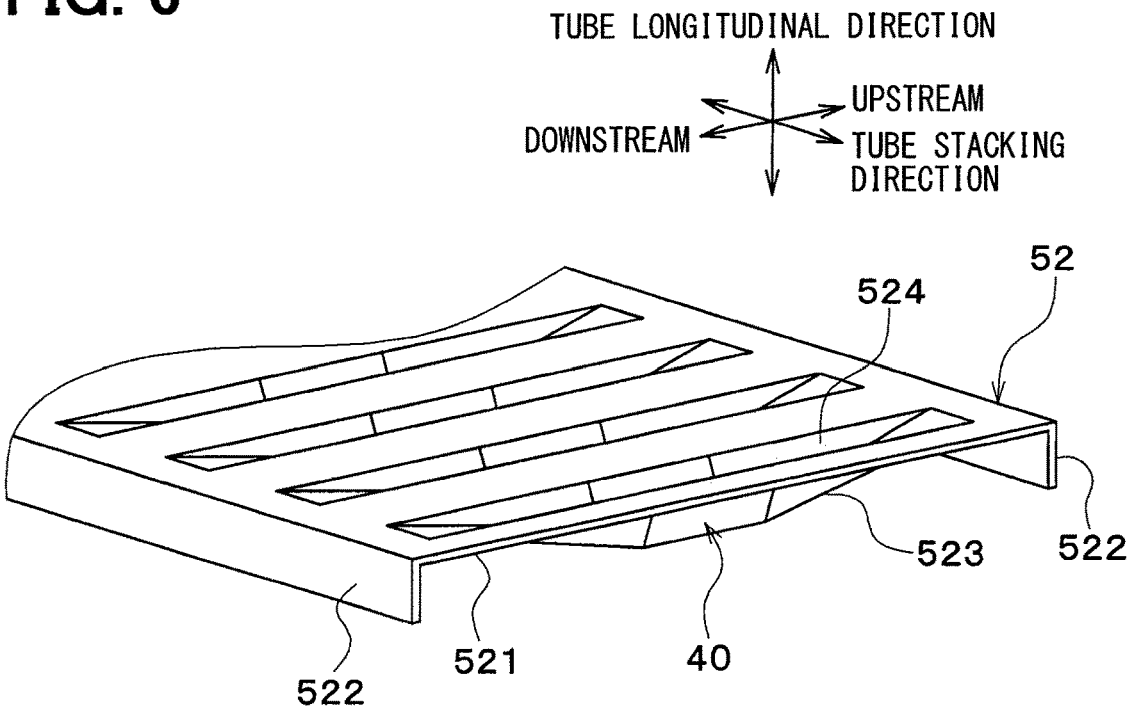
FIG. 6 is an enlarged perspective view of a second plate according to the first embodiment.

As illustrated in FIG. 6, the second plate 52 has a substantially U-shaped portion when viewed along the tube stacking direction. Specifically, the second plate 52 has a flat face portion 521 and two side face portions 522. The flat face portion 521 has a substantially rectangular plate shape and extends in a direction perpendicular to the tube longitudinal direction. The side face portions 522 extend, from end portions in the airflow direction X of the flat face portion 521, in the tube longitudinal direction away from the first core 11 and the second core 21. The flat face portion 521 and the two side face portions 522 are integral with one another.

The flat face portion 521 has ribs 523 that protrude from the flat face portion 521 in the tube longitudinal direction away from the first core 11 and the second core 21 and extend in the airflow direction X. Because of the ribs 523, the flat face portion 521 has recesses 524 in its surface facing the first plate 51. The recesses 524 sink in the tube longitudinal direction away from the first plate 51. Each of the recesses 524 communicates with a corresponding one of the first insertion holes 511 and a corresponding one of the second insertion holes 512, which receive a corresponding one of the pairs of tubes 15 and 25.

Figure 7:
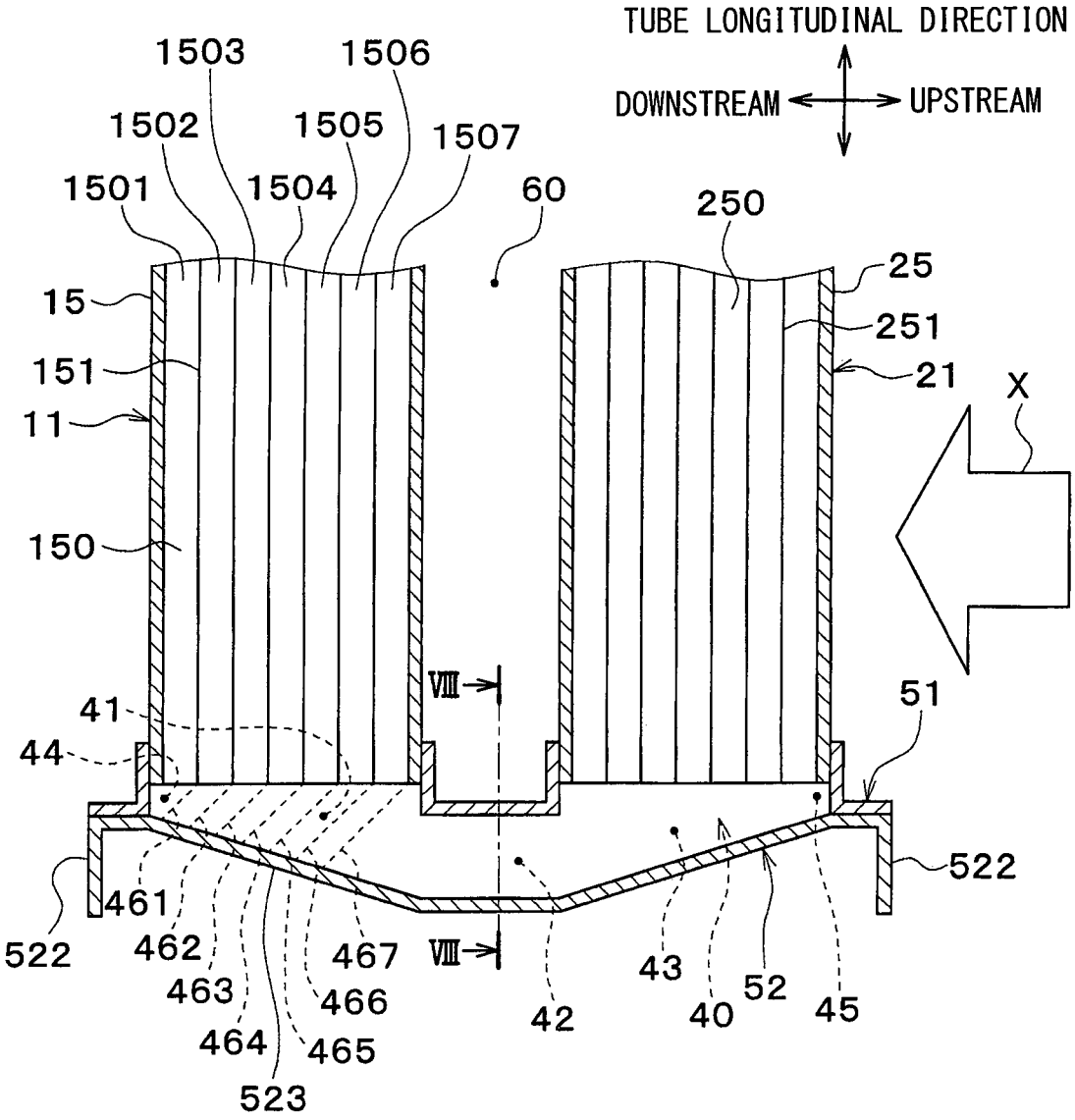
FIG. 7 is an enlarged sectional view of the intermediate tank and its vicinity in the first embodiment.

A portion of the flat face portion 521 where no rib 523 is formed is joined to the first plate 51. As illustrated in FIG. 7, the recesses 524 of the second plate 52, together with a surface of the first plate 51 that faces the ribs 523, define the intermediate passageways 40. In other words, inner side surfaces of the ribs 523 of the second plate 52 and the surface of the first plate 51 that faces the ribs 523 configure the intermediate passageways 40.

Figure 8:
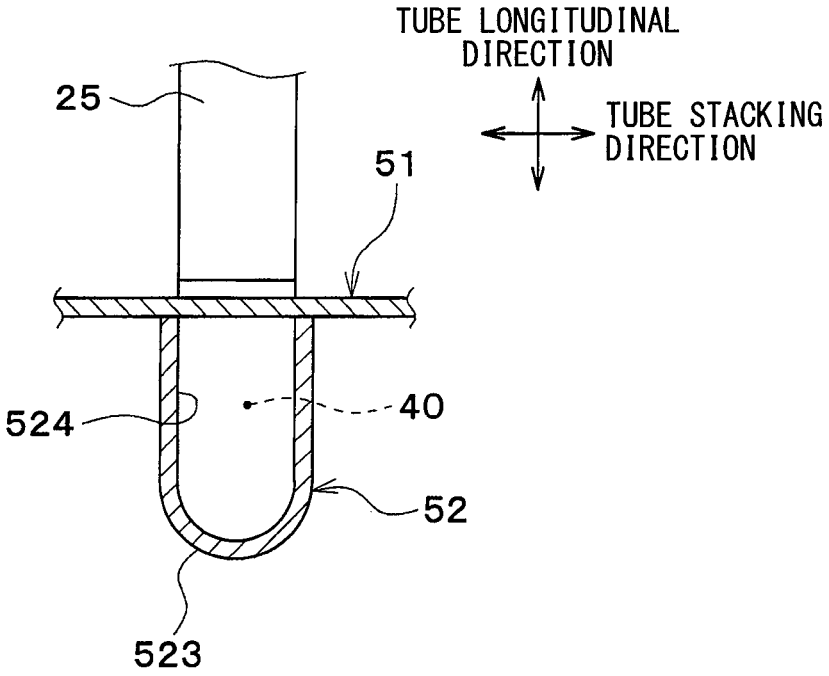
FIG. 8 is a sectional view along VIII-VIII in FIG. 7.

As illustrated in FIG. 8, the ribs 523 each have a substantially U-shaped section when viewed along the airflow direction X. More specifically, the ribs 523 each have a substantially U-shaped section when viewed along the airflow direction X over the entire length in the airflow direction X. In the present embodiment, the ribs 523 have similar configurations; thus, the wording, the rib 523, may cover all the multiple ribs 523 in the description below. The intermediate passageways 40 have similar configurations; thus, the wording, the intermediate passageway 40, may cover all the multiple intermediate passageways 40 in the description below.

In the present embodiment, the intermediate passageway 40 has an uniform length in the tube stacking direction. The cross-sectional area of the intermediate passageway 40 is thus determined based on the length of the intermediate passageway 40 in the tube longitudinal direction.

With reference back to FIG. 7, the intermediate passageway 40 includes an upstream portion 41, a midstream portion 42, and a downstream portion 43. The upstream portion 41, the midstream portion 42, and the downstream portion 43 are disposed in this order set forth from a refrigerant-flow upstream side. The midstream portion 42 has a cross-sectional area larger than those of the upstream portion 41 and the downstream portion 43.

The upstream portion 41 has cross-sectional areas that gradually increase toward a refrigerant-flow downstream side. In the present embodiment, the cross-sectional areas of the upstream portion 41 increase linearly toward the refrigerant-flow downstream side. Specifically, the upstream portion 41 has lengths in the tube longitudinal direction that increase toward the refrigerant-flow downstream side.

The upstream portion 41 is disposed on the one end side in the tube longitudinal direction (i.e., the lower end side) of the first tube 15. The upstream portion 41 communicates with the first tube 15. Refrigerant thus flows from the first tube 15 into the upstream portion 41.

The midstream portion 42 has uniform cross-sectional areas toward the refrigerant-flow downstream side. The midstream portion 42 is disposed at a position that corresponds to that of a gap 60 disposed between the first tube 15 and the second tube 25. The midstream portion 42 is connected to the upstream portion 41. The refrigerant from the upstream portion 41 thus flows into the midstream portion 42.

The downstream portion 43 has cross-sectional areas that gradually decrease toward the refrigerant-flow downstream side. In the present embodiment, the cross-sectional areas of the downstream portion 43 decrease linearly toward the refrigerant-flow downstream side. Specifically, the downstream portion 43 has lengths in the tube longitudinal direction that gradually decrease toward the refrigerant-flow downstream side. The downstream portion 43 is disposed on the one end side in the tube longitudinal direction (the lower end side) of the second tube 25.

The downstream portion 43 is connected at its refrigerant-flow upstream side to the midstream portion 42. The refrigerant from the midstream portion 42 thus flows into the downstream portion 43. The downstream portion 43 is connected at its refrigerant-flow downstream side to the second tube 25. The refrigerant having flowed through the downstream portion 43 thus flows into the second tube 25.

The first tube 15 internally includes a first refrigerant passageway and first partitions 151 that divide the first refrigerant passageway into narrowed passageways 150 that are arranged in the airflow direction X. The second tube 25 internally includes a second refrigerant passageway and second partitions 251 that divide the second refrigerant passageway into narrowed passageways 250 that are arranged in the airflow direction X.

The cross-sectional area of the midstream portion 42 of the intermediate passageway 40 is set to 0.3 times to 3.0 times the cross-sectional area of the first tube 15 or the second tube 25. In other words, the cross-sectional area of the midstream portion 42 of the intermediate passageway 40 is set to 0.3 times to 3.0 times the sum of the cross-sectional areas of the narrowed passageways 150 in the first tube 15 or the sum of the cross-sectional areas of the narrowed passageways 250 in the second tube 25.

The intermediate passageway 40 includes a most-upstream portion 44 that is in the most-upstream location in the airflow direction X of the intermediate passageway 40. The intermediate passageway 40 includes a most-downstream portion 45 that is in the most-downstream location in the airflow direction X of the intermediate passageway 40.

The most-upstream portion 44 and the most-downstream portion 45 are configured to have smallest cross-sectional areas in the intermediate passageway 40. Specifically, the cross-sectional area of the most-upstream portion 44 is set to 0.3 times to 3.0 times the cross-sectional area of each of the narrowed passageways 150 and the narrowed passageways 250, and the cross-sectional area of the most-downstream portion 45 is set to 0.3 times to 3.0 times the cross-sectional area of each of the narrowed passageways 150 and the narrowed passageways 250. In other words, the cross-sectional area of the most-upstream portion 44 is set to 0.3 times to 3.0 times the cross-sectional area of any one of the narrowed passageways 150 or the narrowed passageways 250, and the cross-sectional area of the most-downstream portion 45 is set to 0.3 times to 3.0 times the cross-sectional area of any one of the narrowed passageways 150 or the narrowed passageways 250.

The narrowed passageways 150 in the first tube 15 include a first narrowed passageway 1501 to an $n^{th}$ narrowed passageway **150*n* (where "n" is a natural number) that are arranged sequentially toward the second tubes 25. In other words, the $1^{st}$ narrowed passageway 1501 is farthest from the second tube 25, and the $n^{th}$ narrowed passageway 150*n* is closest to the second tube 25. A portion of the intermediate passageway 40 through which refrigerant that has just flowed out from the $n^{th}$ narrowed passageway 150*n* flows may be hereinafter referred to as an $n^{th}$ outflow portion 46*n***.

In the present embodiment, the narrowed passageways 150 in the first tube 15 include the $1^{st}$ narrowed passageway 1501 to a $7^{th}$ narrowed passageway 1507 that are arranged sequentially toward the second tube 25. The intermediate passageway 40 thus has a $1^{st}$ outflow portion 461 to a $7^{th}$ outflow portion 467 that are arranged sequentially toward the second tube 25.

A method for manufacturing the refrigerant evaporator according to the present embodiment is described below.

Constituent elements of the refrigerant evaporator, such as the first tubes 15, the second tubes 25, the fins 30, the first tank 12, the second tank 22, the first plate 51, and the second plate 52, are manufactured first. Manufacturing methods of the first plate 51 and the second plate 52 of the intermediate tank 50 is described below in detail.

Figure 9:
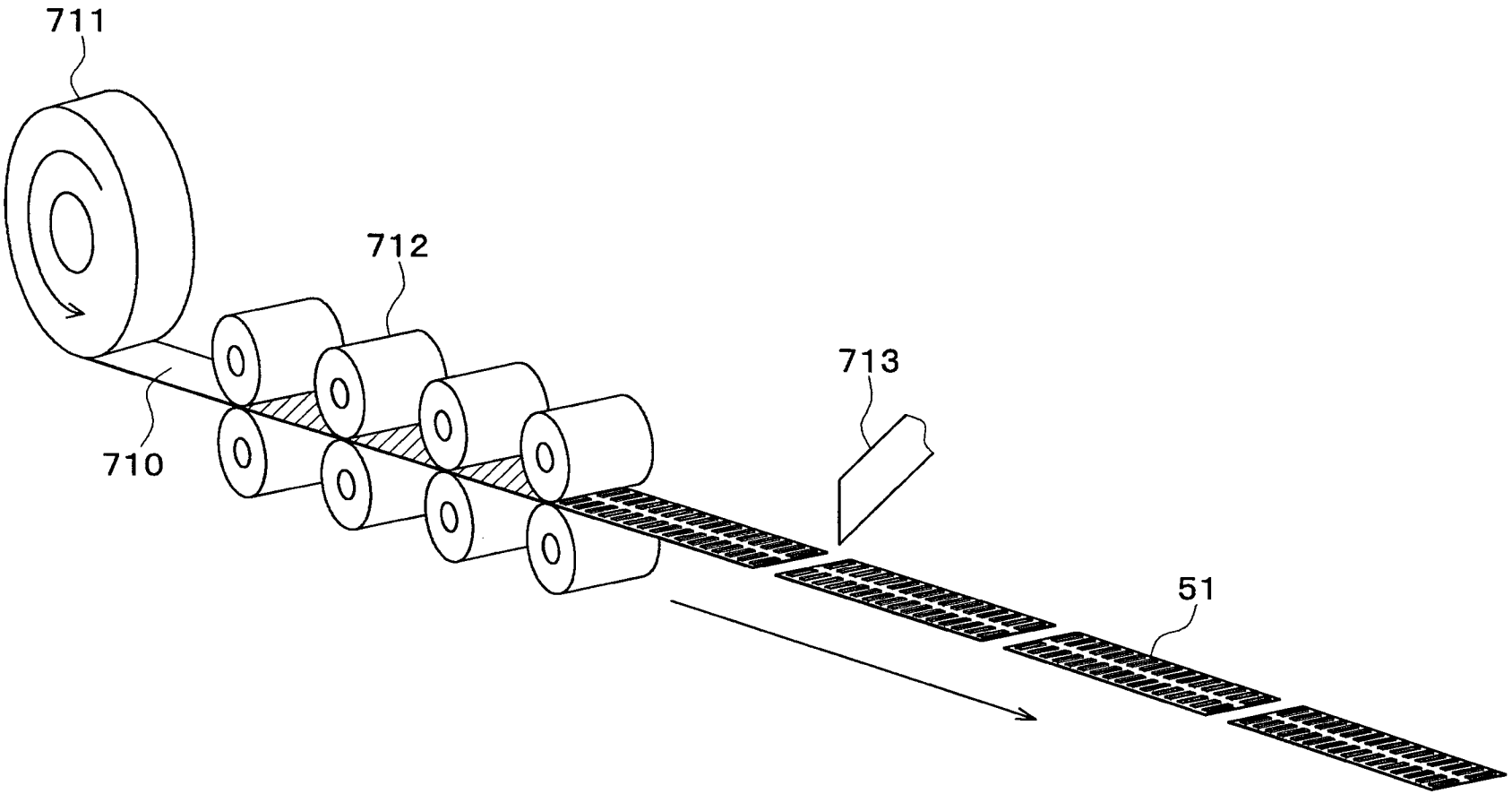
FIG. 9 is a diagram for describing a manufacturing method for the first plate according to the first embodiment.

The first plate 51 of the intermediate tank 50 is fabricated by roll-forming. Specifically, a first elongated thin plate 710 as illustrated in FIG. 9 is provided as a roll material 711. Roll-forming is performed on the roll material 711 using a first roll die 712 to form the insertion holes 511 and 512, which are through holes. The first thin plate 710 that has the insertion holes 511 and 512 formed therein is then cut to a predefined first reference length by a cutter 713. In this manner, the first plate 51 is fabricated.

Figure 10:
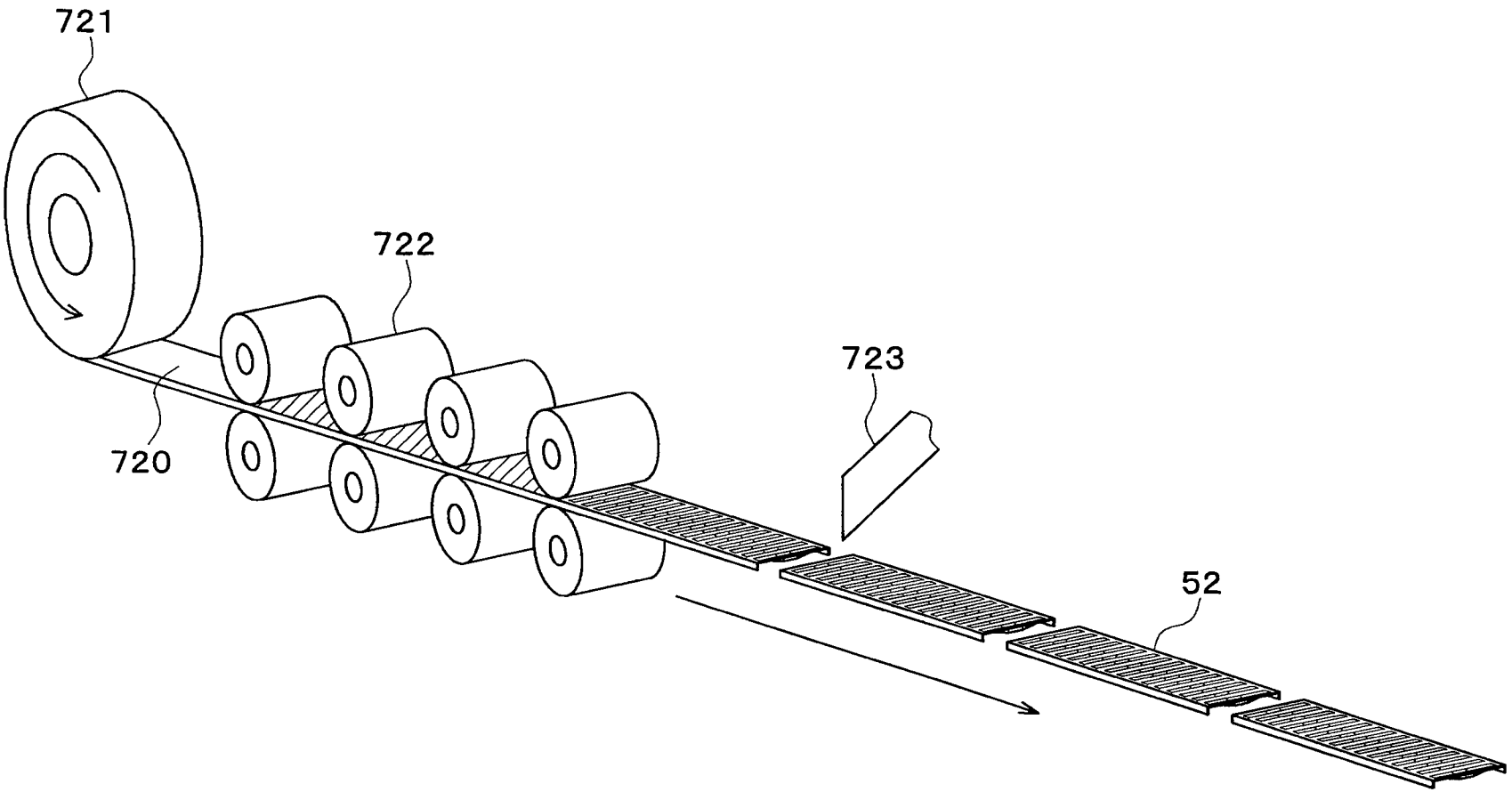
FIG. 10 is a diagram for describing a manufacturing method for the second plate according to the first embodiment.

The second plate 52 of the intermediate tank 50 is then formed by roll-forming. Specifically, a second elongated thin plate 720 as illustrated in FIG. 10 is provided as a roll material 721. Roll-forming is performed on the roll material 721 using a second roll die 722 to form the ribs 523. The second thin plate 720 that has the ribs 523 formed therein is then cut to a predefined second reference length with a cutter 723. In this manner, the second plate 52 is fabricated.

The first tubes 15 and the second tubes 25 are temporarily secured to the first plate 51 and the second plate 52 formed as described above. The fins 30, the first tank 12, and the second tank 22 are temporarily secured to the first tubes 15 and the second tubes 25 temporarily secured as described above. In this manner, a temporary assembly with constituent elements of the refrigerant evaporator temporarily secured thereto is available.

The temporary assembly is heated and thereby brazed in a heating furnace. The constituent elements of the refrigerant evaporator are joined by brazing in this manner, whereby the refrigerant evaporator is completed.

As described above, in the present embodiment, the intermediate passageways 40 are provided on the one end side in the longitudinal direction of the pairs of tubes 15 and 25 for communication between the tubes 15 and 25 in each pair. In the present embodiment, the first tubes 15 and the second tubes 25 form the pairs of tubes 15 and 25. That is, one intermediate passageway 40 is provided for each pair of tubes 15 and 25, and each intermediate passageway 40 can couple one pair of tubes 15 and 25.

An intermediate tank having a large internal volume for distribution or collection of refrigerant for the tubes 15 and 25 can be thus eliminated. The intermediate passageway 40, which is a connection portion between the pair of tubes 15 and 25, inhibits the refrigerant passageways internally disposed in the pair of tubes 15 and 25 from becoming larger or smaller rapidly, thereby capable of reducing the difference between the refrigerant flow velocity in the intermediate passageway 40 and that in the tube 15 and the difference between the refrigerant flow velocity in the intermediate passageway 40 and that in the tube 25 in the pair. Increase of the pressure loss in the intermediate passageway 40 and degradation of refrigerant distribution to the second tubes 25 can be thus inhibited.

By promoting reduction of the pressure loss and an even distribution of refrigerant as described above, the efficiency of heat transfer of the refrigerant evaporator can be increased and cooling capability of a vehicle air conditioning device can be improved. Power consumption of the compressor as well as the size and weight of the refrigerant evaporator can be reduced at the same cooling capability.

The cross-sectional area of the $n^{th}$ narrowed passageway 150*n* in the first tube 15 as illustrated in FIG. 7 is denoted as Sn. The cross-sectional area of the nth outflow portion 46*n* in the intermediate passageway 40 is denoted as Mn. Here, the intermediate passageway 40 according to the present embodiment is configured to satisfy an expression (1) described below. In the expression (1), k is a natural number equal to or smaller than n.

[Expression 1]

$$0.3\sum_{i=1}^{k} S_i < M_k < 3.0\sum_{i=1}^{k} S_i \tag{1}$$

For example, the intermediate passageway 40 according to the present embodiment is configured to satisfy relationships described below.

$$0.3S1<M1<3.0S1,$$

$$0.3(S1+S2)<M2<3.0(S1+S2),$$

$$0.3(S1+S2+S3)<M7<3.0(S1+S2+S3),$$

$$0.3(S1+S2+S3+S4)<M7<3.0(S1+S2+S3+S4),$$

$$0.3(S1+S2+S3+S4+S5)<M7<3.0(S1+S2+S3+S4+S5),$$

$$0.3(S1+S2+S3+S4+S5+S6)<M7<3.0(S1+S2+S3+S4+S5+S6),$$

and $$0.3(S1+S2+S3+S4+S5+S6+S7)<M7<3.0(S1+S2+S3+S4+S5+S6+S7).$$

Then, the area of the refrigerant passageway can be inhibited from increasing rapidly when refrigerant flows out from the narrowed passageways 150 of the first tube 15 into the intermediate passageway 40, whereby the pressure loss can be reduced.

The intermediate passageway 40 is desirably configured to satisfy an expression (2) described below. In the expression (2), k is a natural number equal to or smaller than n.

[Expression 2]

$$0.5\sum_{i=1}^{k} S_i < M_k < 2.0\sum_{i=1}^{k} S_i \tag{2}$$

For example, the intermediate passageway 40 according to the present embodiment is configured to satisfy relationships described below.

$$0.5S1<M1<2.0S1,$$

$$0.5(S1+S2)<M2<2.0(S1+S2),$$

$$0.5(S1+S2+S3)<M2<2.0(S1+S2+S3),$$

$$0.5(S1+S2+S3+S4)<M2<2.0(S1+S2+S3+S4),$$

$$0.5(S1+S2+S3+S4+S5)<M2<2.0(S1+S2+S3+S4+S5),$$

$$0.5(S1+S2+S3+S4+S5+S6)<M2<2.0(S1+S2+S3+S4+S5+S6),$$

and $$0.5(S1+S2+S3+S4+S5+S6+S7)<M7<2.0(S1+S2+S3+S4+S5+S6+S7).$$

Then, the area of the refrigerant passageway can be further inhibited from increasing rapidly when refrigerant flows out from the narrowed passageways 150 of the first tube 15 into the intermediate passageway 40, whereby the pressure loss can be further reduced.

A conventional refrigerant evaporator including an intermediate tank having a large internal volume for distribution or collection of refrigerant for first tubes 15 and second tubes 25 is referred to as a refrigerant evaporator of a first comparative example.

In an intermediate period, winter, and other periods when the cooling thermal load is low, lowering the refrigerant flow rate, the refrigerant evaporator according to the first comparative example that includes the intermediate tank downward of the heat-exchange cores suffers a significant reduction in flow velocity of refrigerant due to the large internal volume of the intermediate tank, which results in a greater likelihood that refrigerating machine oil mixed in the refrigerant is retained in the intermediate tank. Additionally, refrigerant in the liquid phase is likely to be retained in the intermediate tank due to the low cooling thermal load. The refrigerating cycle may be thus operated with a shortage of refrigerating machine oil or refrigerant, possibly resulting in failure or insufficient performance of the refrigerating machine.

Additionally, refrigerant in a gas-liquid two-phase state is present in the intermediate tank, with the refrigerant flowing through the tubes 15 and 25 having different ratios of the gas phase to the liquid phase. The first tubes 15 and the second tubes 25 thus have different inlet-to-outlet differential pressures, resulting in imbalance in flow rate of refrigerant flowing through the first tubes 15 and the second tubes 25. The refrigerant distribution may be thus degraded.

When liquid-phase refrigerant is retained in the intermediate tank, the level of the liquid-phase refrigerant may reach an outlet portion of the intermediate tank to the second tube 25. Refrigerant in both of the liquid and gas states may cause noise when flowing into the second tube 25.

In contrast, the first tube 15 of the first core 11 is coupled to the second tube 25 of the second core 21 by the intermediate passageway 40, which has a small internal volume, in the present embodiment. Liquid-phase refrigerant and refrigerating machine oil that have flown into the intermediate passageway 40 will thus flow into the second tube 25 without being retained in the intermediate passageway 40 even at a low refrigerant flow rate. Operation of the refrigerating cycle with a shortage of refrigerant or refrigerating machine oil can be thus inhibited.

As a result, the amounts of refrigerant and refrigerating machine oil used in the refrigerating cycle can be reduced. Additionally, liquid-phase refrigerant and refrigerating machine oil are inhibited from being retained (stagnating) at a bottom portion of the intermediate tank, which can thereby reduce refrigerant-passing-noise.

With each intermediate passageway 40 coupling one first tube 15 of the first core 11 to one second tube 25 of the second core 21 as in the present embodiment, uniform amounts of refrigerant distributed to each of the second tubes 25 can be maintained even when the refrigerant evaporator is installed at an angle tilted from a vertical position. The cooling capability of a vehicle air conditioning device can be thus maintained.

Here, a conventional refrigerant evaporator including an intermediate passageway 40 configured by stacking three plates, i.e., a first plate member, a second plate member, and a third plate member, is referred to as a refrigerant evaporator according to a second comparative example. The intermediate passageway 40 of the refrigerant evaporator according to the second comparative example is configured using three plate members, resulting in an increased number of constituent elements.

The second plate member used in the intermediate passageway of the refrigerant evaporator according to the second comparative example is fabricated by performing a punching process on a metal material having a flat plate shape. The area of the passageway in the intermediate passageway thus depends on the thickness of the second plate member. The second plate member generally has a small thickness, thus unable to increase the area of the passageway in the intermediate passageway, resulting in increase of the pressure loss. Increasing the thickness of the second plate member to thereby increase the area of the passageway in the intermediate passageway may be conceivable, which will, however, lead to increase in the amount of the material for the second plate member, possibly resulting in an increased weight, degraded workability, and increased material costs.

Furthermore, the three plate members, which have significant heat capacities, and the tubes have different heat capacities and transfer heat differently when they are joined to one another by brazing. This causes undesirable brazing conditions and thus difficulty in manufacturing.

In contrast, the intermediate passageways 40 in the present embodiment are configured by using the first plate 51 and the second plate 52. Increase of constituent elements in number can be thus inhibited. Additionally, the amount of materials necessary to fabricate the refrigerant evaporator can be reduced; thus, the weight can be reduced and degradation of workability can be inhibited. Material and process costs can be thus reduced.

Furthermore, the intermediate tank 50 (the first plate 51 and the second plate 52) is made using the two thin plates 710 and 720, which have small and mostly even heat capacities; thus the first plate 51 and the second plate 52 can be joined together by brazing. Thus, a highly reliable hermetic seal can be readily provided to the intermediate tank 50 by brazing.

Additionally, the first plate 51 and the second plate 52 are fabricated by roll-forming and can be thus processed continuously using the roll dies 712 and 722. Increased production speed can thus become available for the intermediate tank 50, thereby capable of producing a large number of refrigerant evaporators in the same period of time.

Furthermore, since the first plate 51 and the second plate 52 are fabricated by roll-forming, a change to the required cooling capability of the refrigerant evaporator can be readily satisfied by cutting the thin plates 710 and 720 to lengths corresponding to the required cooling capability. The number of man-hours for designing and that for manufacturing setups can be thus reduced.

Furthermore, by forming the second plate 52 to provide the U-shaped section when viewed from the tube stacking direction, the stiffness of the second plate 52 can be improved due to rib effect. The thickness of the second plate 52 can be thus reduced, and thereby the weight of the refrigerant evaporator can be reduced.

Second Embodiment

A second embodiment of the present disclosure is described below with reference to FIGS. 11 and 12. The second embodiment is different from the first embodiment described above in shape and other features of the tubes 15 and 25.

Figure 11:
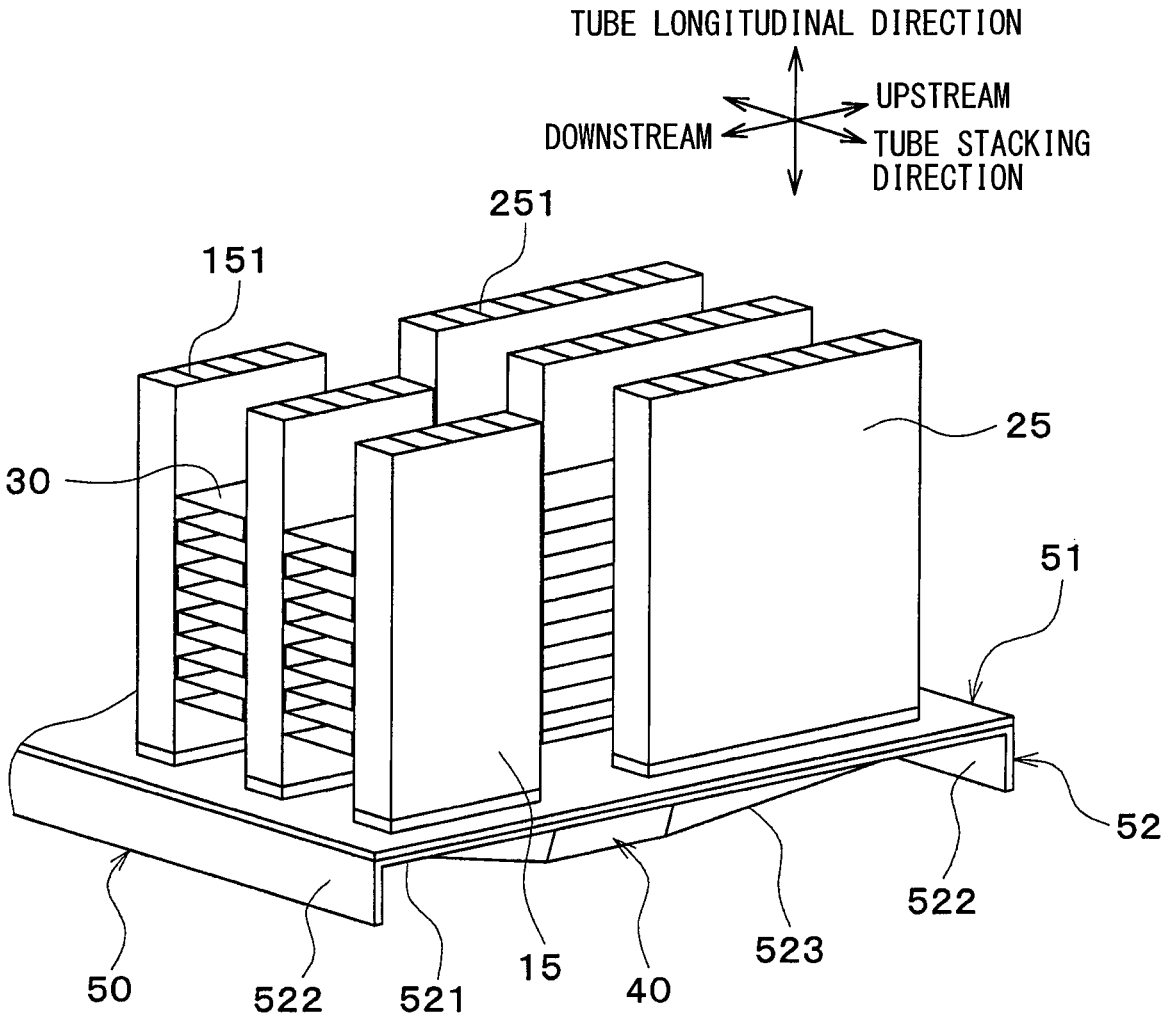
FIG. 11 is an enlarged perspective view of a portion of a refrigerant evaporator according to a second embodiment.
Figure 12:
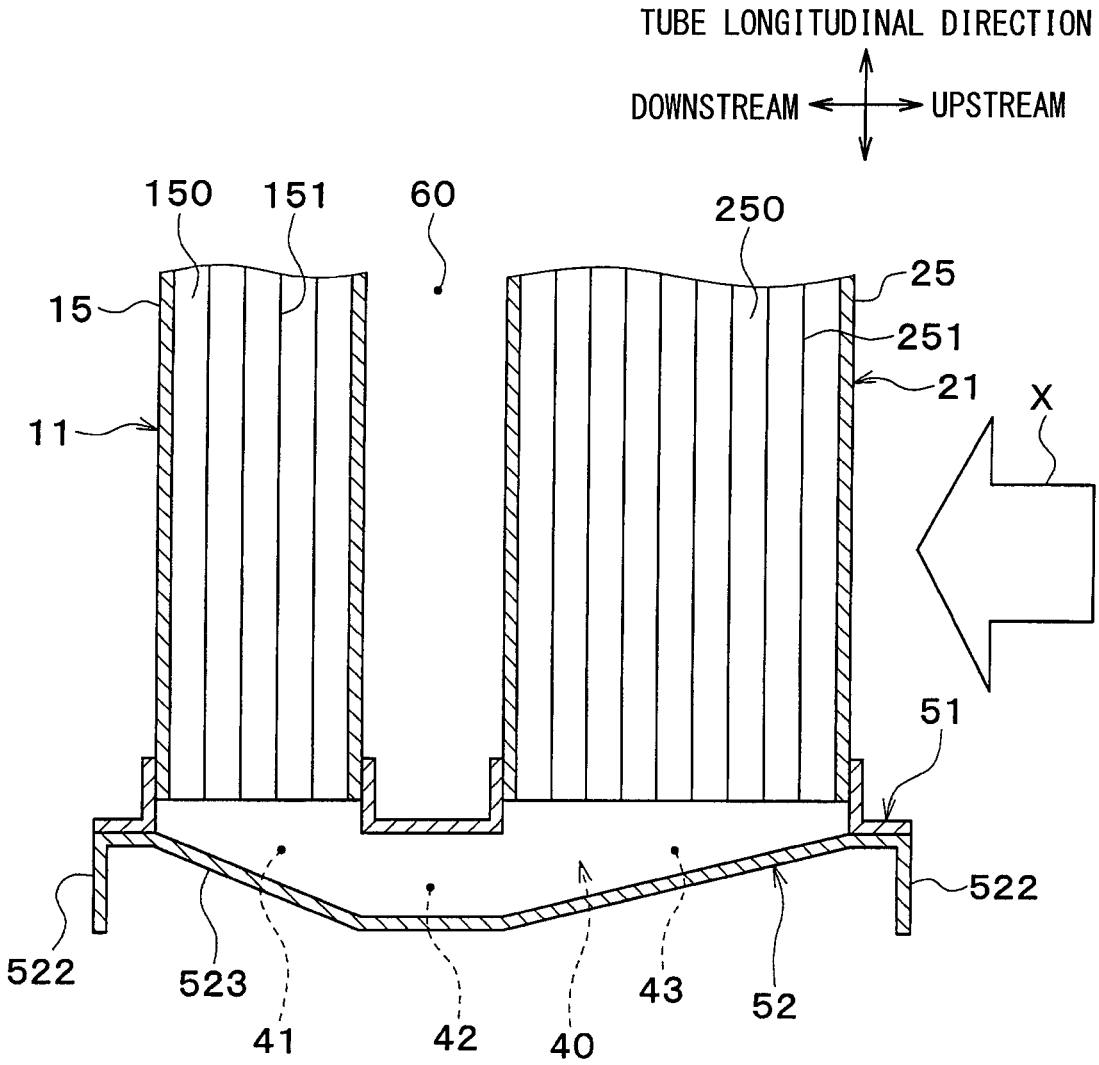
FIG. 12 is an enlarged sectional view of an intermediate tank and its vicinity in the second embodiment.

As illustrated in FIGS. 11 and 12, a first tube 15 has a cross-sectional area smaller than that of a second tube 25 in the present embodiment. Specifically, the first tube 15 has a length in the airflow direction X shorter than that of the second tube 25. Additionally, the number of narrowed passageways 150 in the first tube 15 is smaller than the number of narrowed passageways 250 in the second tube 25.

In the present embodiment, in the first tube 15 and the second tube 25, the cross-sectional area of the first tube 15, through which a large amount of liquid-phase refrigerant flows, can be reduced, and the cross-sectional area of the second tube 25, through which a large amount of gas-phase refrigerant flows, can be increased. Maximization of flow velocity of refrigerant and minimization of the amount of refrigerant pressure loss in the tubes 15 and 25 can be thus promoted, and thereby cooling performance of a vehicle air conditioning device can be improved.

Third Embodiment

A third embodiment of the present disclosure is described below with reference to FIGS. 13 and 14. The third embodiment is different from the first embodiment described above in shape and other features of the intermediate tank 50.

Figure 13:
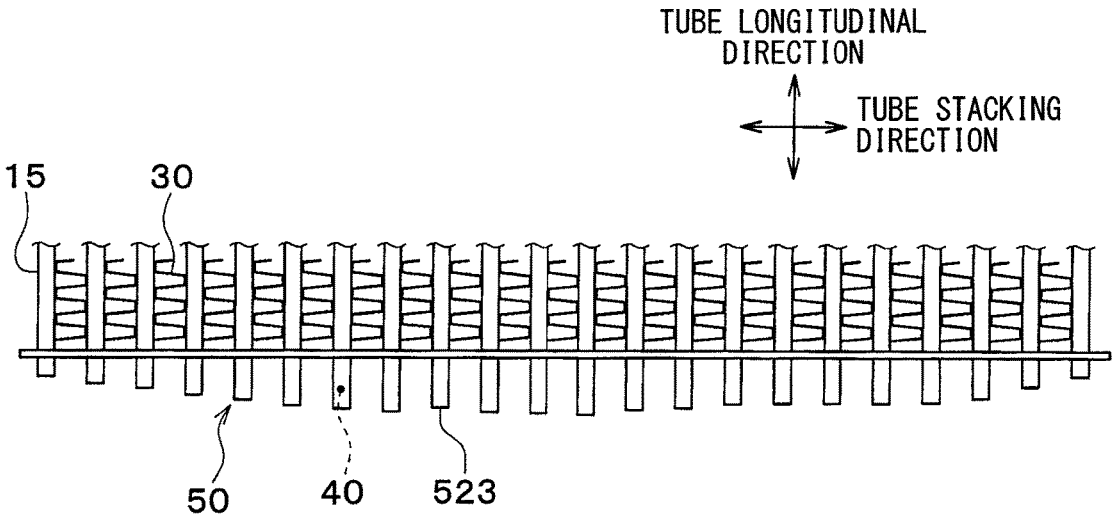
FIG. 13 is an enlarged front view of a portion of a refrigerant evaporator according to a third embodiment.
Figure 14:
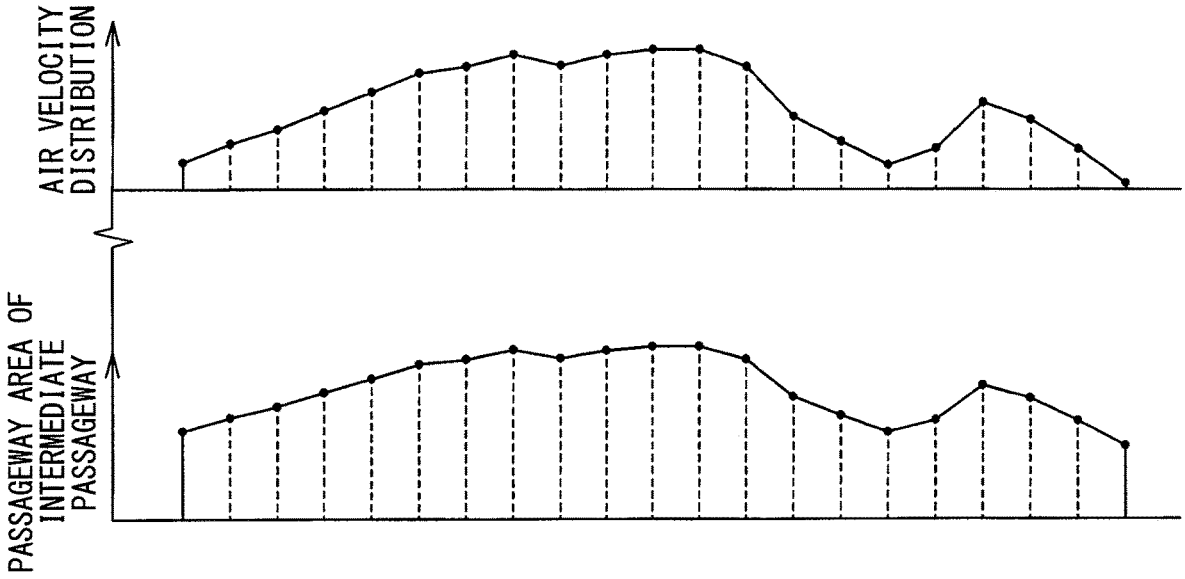
FIG. 14 is a characteristic diagram indicating a relationship between an air velocity distribution and the sectional area of an intermediate passageway in the refrigerant evaporator.

As illustrated in FIG. 13, intermediate passageways 40, which are ribs 523, arranged in the tube stacking direction have mutually different shapes in the present embodiment. Specifically, the intermediate passageways 40 (the ribs 523) have mutually different lengths in the tube longitudinal direction when viewed along the airflow direction X. The intermediate passageways 40 are thus mutually different in the area of the passageway.

Specifically, one of the intermediate passageways 40, located in a portion of an intermediate tank 50 that has a larger air thermal load, has a larger area of the passageway in the present embodiment. More specifically, as illustrated in FIG. 14, one of the intermediate passageways 40, located in a portion of the intermediate tank 50 through which air flows at a higher air velocity, has a larger area of the passageway.

That is, one of the intermediate passageways 40 (a rib 523) located in a portion subjected to a higher air velocity has a longer length in the tube longitudinal direction. The intermediate passageways 40 (the ribs 523) have the same lengths in the tube stacking direction.

In the present embodiment, the area of the passageway of one of the intermediate passageways 40 in a location having an elevated air thermal load can be increased, and the area of the passageway of one of the intermediate passageways 40 in a location having a lowered air thermal load can be reduced. Gas-phase refrigerant flowing from the intermediate passageways 40 to most-downstream locations of second tubes 25 can thus have uniform degrees of superheating, which causes the overall areas of a refrigerant evaporator to serve as refrigerant evaporation areas. As a result, liquid-phase refrigerant can be inhibited from flowing into the compressor (liquid-back phenomenon), and gas-phase refrigerant having an excessive degree of superheating can be inhibited from flowing into the compressor. The cooling performance of a vehicle air conditioning device can be thus improved, and power consumption of the compressor can be reduced.

Fourth Embodiment

Figure 15:
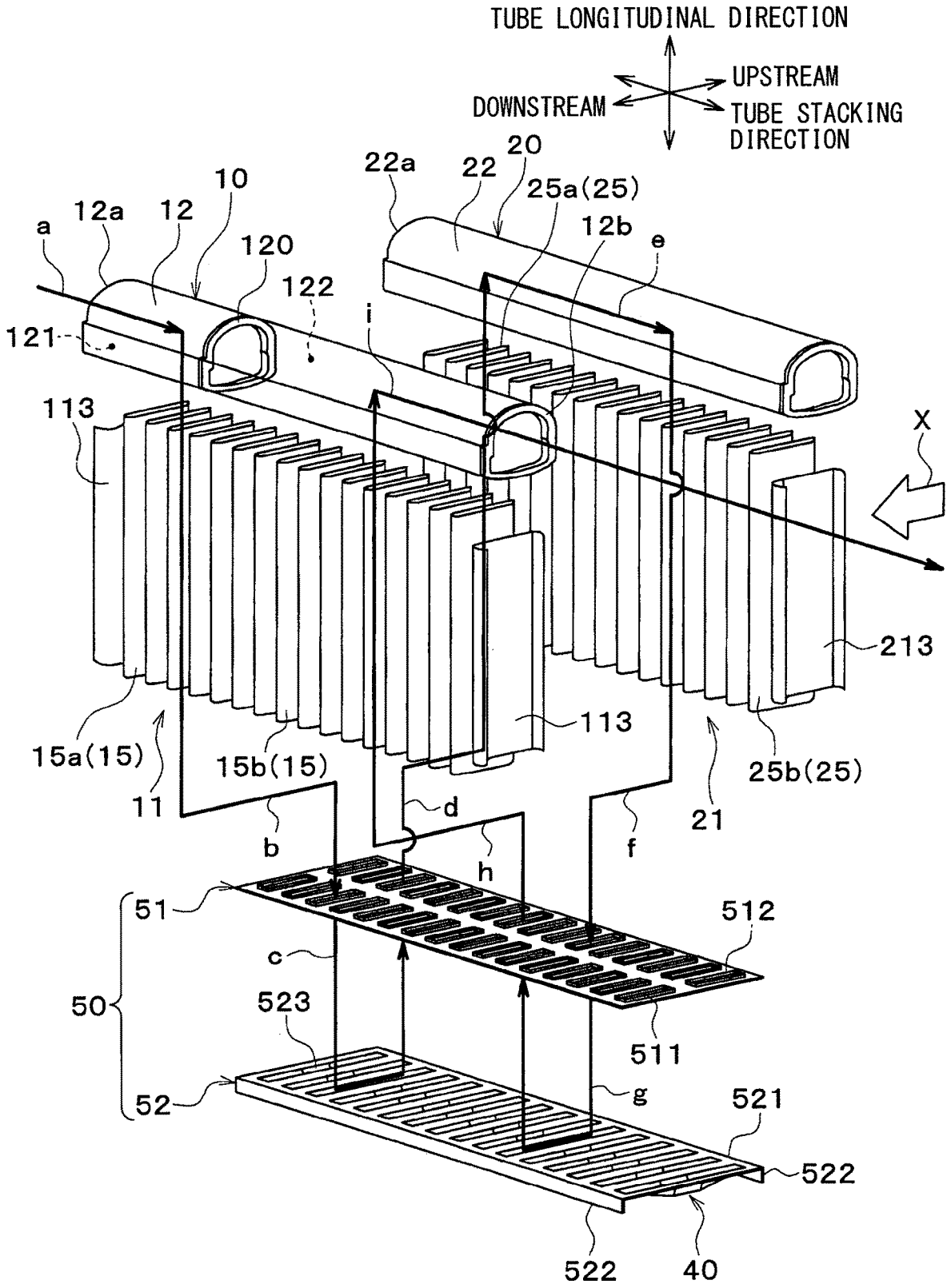
FIG. 15 is an exploded perspective view of a refrigerant evaporator according to a fourth embodiment.

A fourth embodiment of the present disclosure is described below with reference to FIG. 15. The fourth embodiment is different from the first embodiment described above in shape and other features of the first tank 12. In FIG. 15, illustration of fins 30 is omitted.

As illustrated in FIG. 15, a first tank 12 according to the present embodiment has a refrigerant outlet 12*b* formed on one end side in the tube stacking direction (a right-hand side of the paper in FIG. 15). The refrigerant outlet 12*b* emits refrigerant from the first tank 12 toward the inlet of the compressor (not shown).

The first tank 12 internally includes a partition 120 that partitions an internal space of the first tank 12 into two spaces in the tube stacking direction. The partition 120 partitions the internal space of the first tank 12 into a first space 121 and a second space 122. In the present embodiment, the partition 120 is placed beyond a middle portion of the first tank 12 in the tube stacking direction toward a refrigerant inlet 12*a*.

The first space 121 communicates with the refrigerant inlet 12*a*. The refrigerant inlet 12*a* constitutes an inflow portion that allows refrigerant to flow into the first space 121 from outside.

The second space 122 communicates with the refrigerant outlet 12*b*. The refrigerant outlet 12*b* constitutes an outflow portion that allows refrigerant to flow from the second space 122 to the outside.

Of first tubes 15 included in a first core 11, those first tubes 15 that communicate with the first space 121 may be referred to as first inflow tubes 15*a*, and those first tubes 15 that communicate with the second space 122 may be referred to as first outflow tubes 15*b*.

Of second tubes 25 included in a second core 21, those second tubes 25 that face the first inflow tubes 15*a*, i.e., those second tubes 25 placed upstream of the first inflow tubes 15*a* with respect to the airflow, may be referred to as second inflow tubes 25*a*. Of the second tubes 25 included in the second core 21, those second tubes 25 that face the second outflow tubes 15*b*, i.e., those second tubes 25 placed upstream of the second outflow tubes 15*b* with respect to the airflow, may be referred to as second outflow tubes 25*b*.

Flow of refrigerant in a refrigerant evaporator according to the present embodiment is described next with reference to FIG. 15.

As indicated by an arrow a, refrigerant having a lowered pressure resulting from pressure reduction at the expansion valve is admitted into the first space 121 from the refrigerant inlet 12*a*, which is included on the other end side in the tube stacking direction of the first tank 12. As indicated by an arrow b, the refrigerant admitted in the first space 121 flows downward through the first inflow tubes 15*a* of the first core 11.

As indicated by an arrow c, the refrigerant flown downward through the first inflow tubes 15*a* flows through corresponding ones of intermediate passageways 40 of an intermediate tank 50 from an airflow downstream side to an airflow upstream side into the second inflow tubes 25*a* of the second core 21. As indicated by an arrow d, the refrigerant flown into the second inflow tubes 25*a* flows upward through the second inflow tubes 25*a* into the second tank 22.

As indicated by an arrow e, the refrigerant flown into the second tank 22 flows in the second tank 22 toward one end side in the tube stacking direction of the second tank 22 from the other end side in the tube stacking direction of the second tank 22 (from a left-hand side to the right-hand side of the paper in FIG. 15) into the second outflow tubes 25*b* of the second core 21. As indicated by an arrow f, the refrigerant flown into the second outflow tubes 25*b* flows downward through the second outflow tubes 25*b* into corresponding ones of the intermediate passageways 40 of the intermediate tank 50.

As indicated by an arrow g, the refrigerant flown into the corresponding ones of the intermediate passageways 40 flows therethrough from the airflow upstream side to the airflow downstream side into the first outflow tubes 15*b* of the first core 11. As indicated by an arrow h, the refrigerant flown into the first outflow tubes 15*b* flows upward through the first outflow tubes 15*b* into the second space 122 of the first tank 12. As indicated by an arrow i, the refrigerant flown into the second space 122 is emitted toward the inlet of the compressor from the refrigerant outlet 12*b* formed on the one end side in the tube stacking direction of the first tank 12.

In the present embodiment, by using the partition 120 included in the first tank 12, the numbers of tubes 15 and 25 used at the refrigerant-flow upstream side of the refrigerant evaporator can be reduced and the numbers of tubes 15 and 25 used at the refrigerant-flow downstream side can be increased. Maximization of flow velocity of refrigerant and minimization of the amount of refrigerant pressure loss in the tubes 15 and 25 can be thus promoted, and thereby the cooling performance of a vehicle air conditioning device can be improved.

Fifth Embodiment

Figure 16:
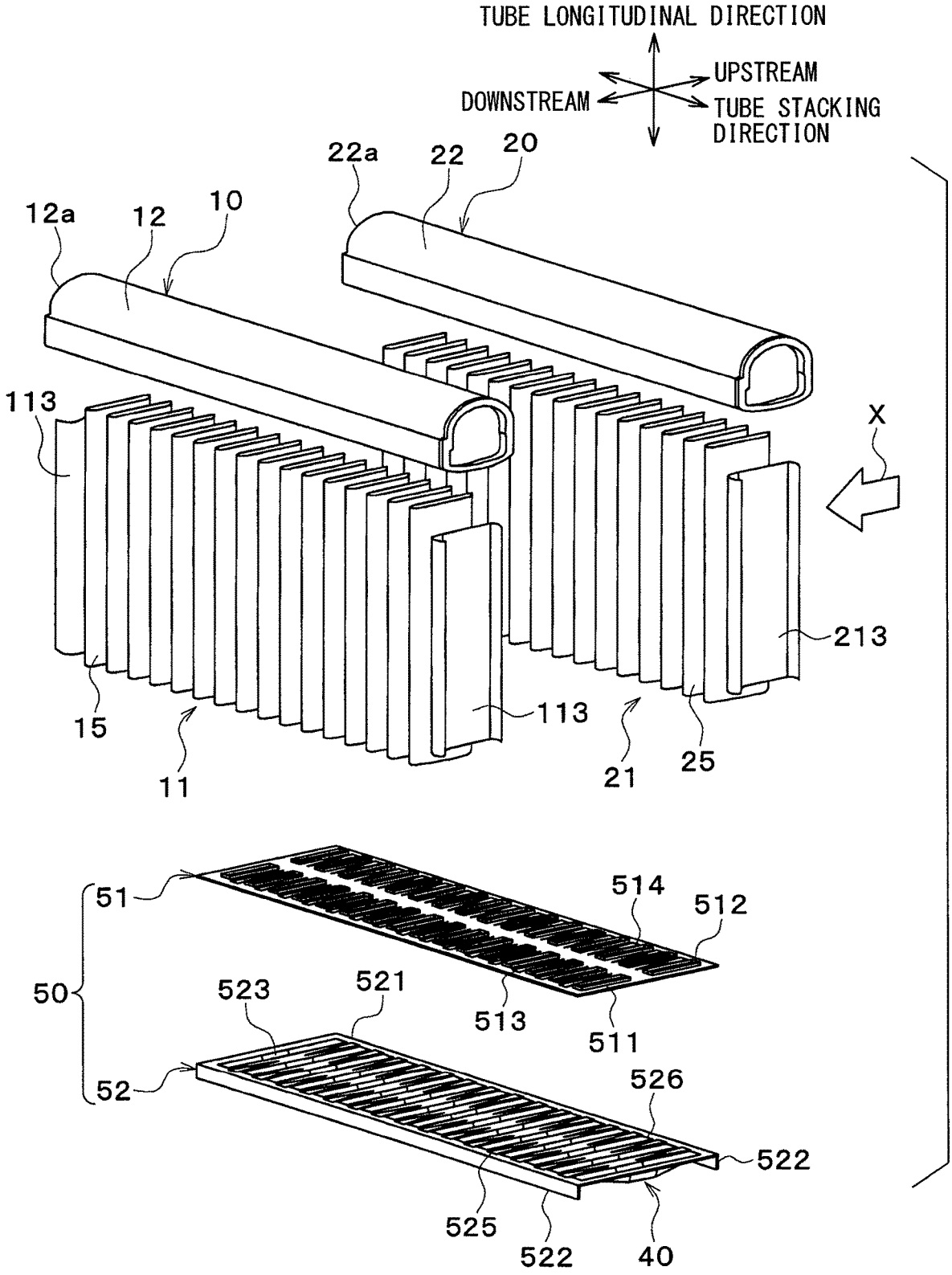
FIG. 16 is an exploded perspective view of a refrigerant evaporator according to a fifth embodiment.

A fifth embodiment of the present disclosure is described below with reference to FIGS. 16, 17, 18, and 19. The present fifth embodiment is different from the first embodiment described above in that an intermediate tank 50 includes a configuration for improving draining. In FIG. 16, illustration of fins 30 is omitted.

As illustrated in FIG. 16, portions of the first plate 51 where no intermediate passageway 40 is provided include drain holes 513 and 514. The drain holes 513 and 514 are through holes that penetrate through the first plate 51. Portions of the second plate 52 where no intermediate passageway 40 is provided include drain holes 525 and 526. The drain holes 525 and 526 are through holes that penetrate through the second plate 52.

That is, the first plate 51 has the drain holes 513 and 514 for draining condensate water. The second plate 52 has the drain holes 525 and 526 for draining condensate water. The positions of the drain holes 525 and 526 in the second plate 52 correspond to those of the drain holes 513 and 514 in the first plate 51.

Condensate water occurring in the cores 11 and 21 and moving downward on the tubes 15 and 25 or fins 30 are thus discharged through the drain holes 513, 514, 525, and 526 downward from the refrigerant evaporator.

Figure 17:
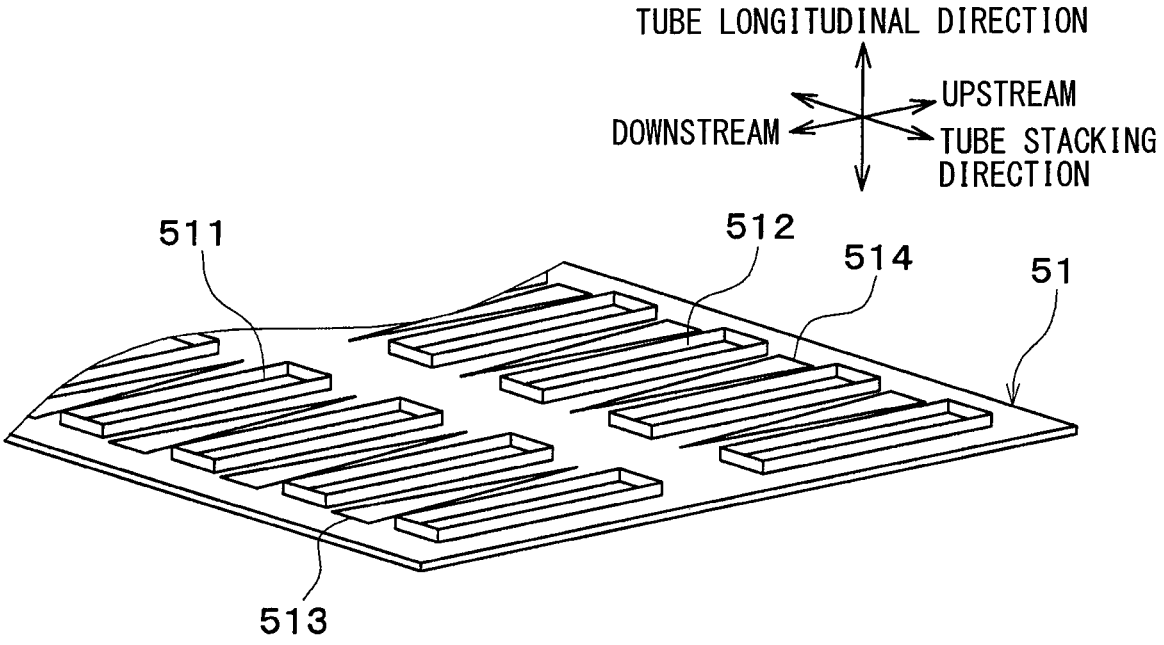
FIG. 17 is an enlarged perspective view of a first plate according to the fifth embodiment.

Specifically, as illustrated in FIG. 17, a first drain hole 513 is provided between adjacent ones of first insertion holes 511 in the first plate 51. A second drain hole 514 is also provided between adjacent ones of second insertion holes 512 in the first plate 51. The first drain holes 513 and the second drain holes 514 are through holes that penetrate through the first plate 51.

In the present embodiment, the first drain hole 513 and the second drain hole 514 each have a triangular shape. Specifically, the first drain hole 513 has an isosceles triangle shape having a base on the airflow downstream side. The second drain hole 514 has an isosceles triangle shape having a base toward the airflow upstream side.

Figure 18:
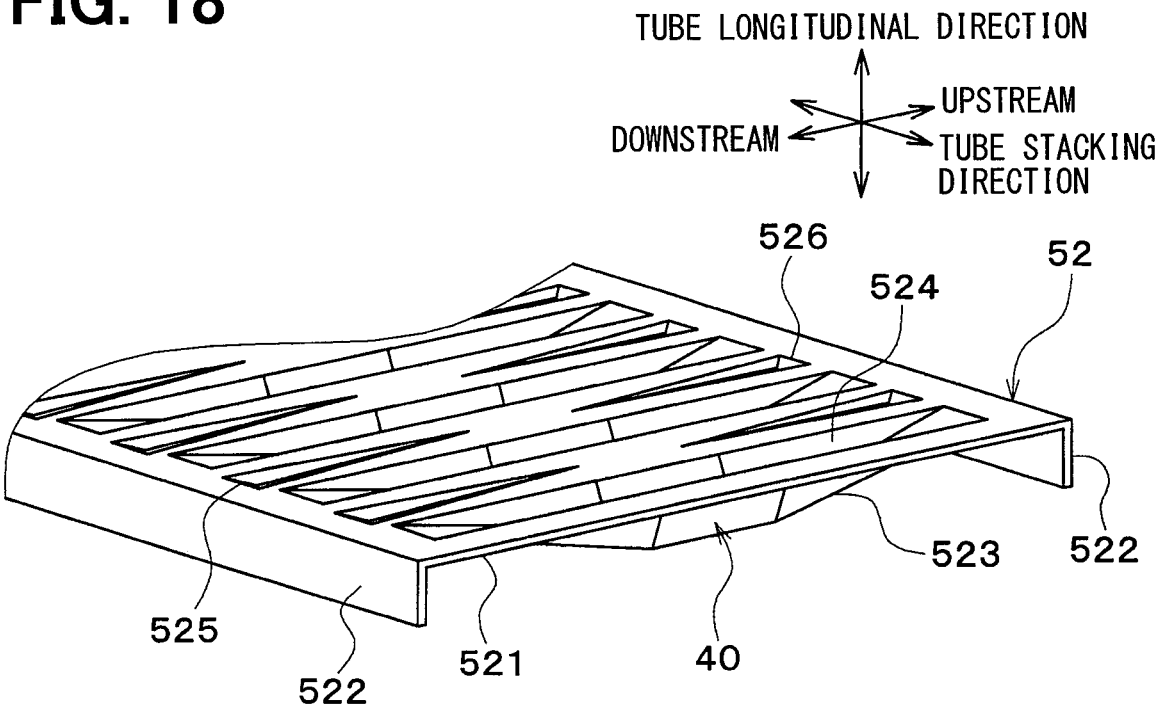
FIG. 18 is an enlarged perspective view of a second plate according to the fifth embodiment.

As illustrated in FIG. 18, a third drain hole 525 and a fourth drain hole 526 are provided between adjacent ones of ribs 523 in the second plate 52. The third drain hole 525 and the fourth drain hole 526 are arranged in the airflow direction X. The third drain hole 525 is placed downstream of the fourth drain hole 526 with respect to the airflow. The third drain holes 525 and the fourth drain holes 526 are through holes that penetrate through the second plate 52.

The positions of the third drain holes 525 correspond to those of the first drain holes 513 in the first plate 51. The third drain hole 525 has a shape similar to that of the first drain hole 513 when viewed from the tube longitudinal direction. That is, the third drain hole 525 has an isosceles triangle shape having a base on the airflow downstream side.

The positions of the fourth drain holes 526 correspond to those of the second drain holes 514 in the first plate 51. The fourth drain hole 526 has a shape similar to that of the second drain hole 514 when viewed from the tube longitudinal direction. That is, the fourth drain hole 526 has an isosceles triangle shape having a base on the airflow upstream side.

Figure 19:
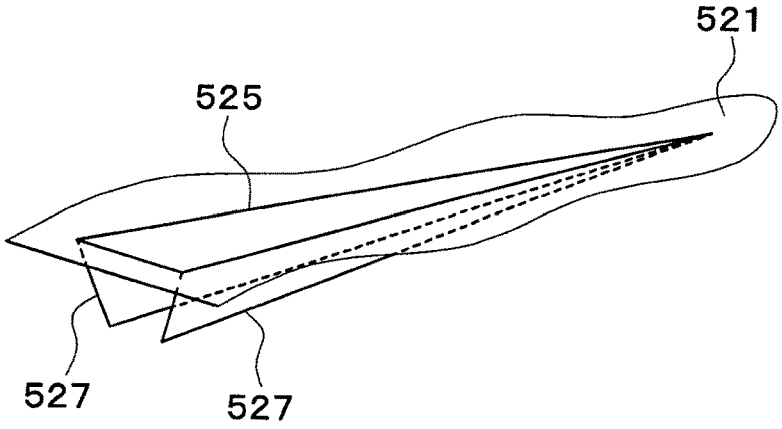
FIG. 19 is an enlarged perspective view of a drain hole and its vicinity in the second plate according to the fifth embodiment.

As illustrated in FIG. 19, bent portions 527 bent downward are placed in outer perimeter portions of the third drain hole 525. Each of the bent portions 527 is a portion that is bent while the third drain hole 525 is formed by roll forming. In the present embodiment, the bent portion 527 is provided on each of the two equal sides of the isosceles triangle shape of the third drain hole 525. Although omitted in FIG. 19, similar bent portions 527 are also placed in an outer perimeter portion of the fourth drain hole 526.

In the present embodiment, condensate water occurring in the cores 11 and 21 can be discharged from the drain holes 513, 514, 525, and 526 by providing the drain holes 513, 514, 525, and 526 in the first plate 51 and the second plate 52.

The first plate 51 and the second plate 52 are fabricated by roller forming (a rolling process) which can perform microfabrication. Thus, the drain holes 513 and 514, in addition to the insertion holes 511 and 512, can be formed in the first plate 51, and the drain holes 525 and 526, in addition to the ribs 523 can be formed in the second plate 52, as in the present embodiment.

Furthermore, the bent portions 527 are provided in the outer perimeter portions of the drain holes 525 and 526 in the second plate 52 in the present embodiment. The bent portions 527 can facilitate water dripping from the drain holes 525 and 526.

Sixth Embodiment

A sixth embodiment of the present disclosure is described below with reference to FIGS. 20 and 21. The sixth embodiment is different from the fifth embodiment described above in shape of the intermediate tank 50.

Figure 20:
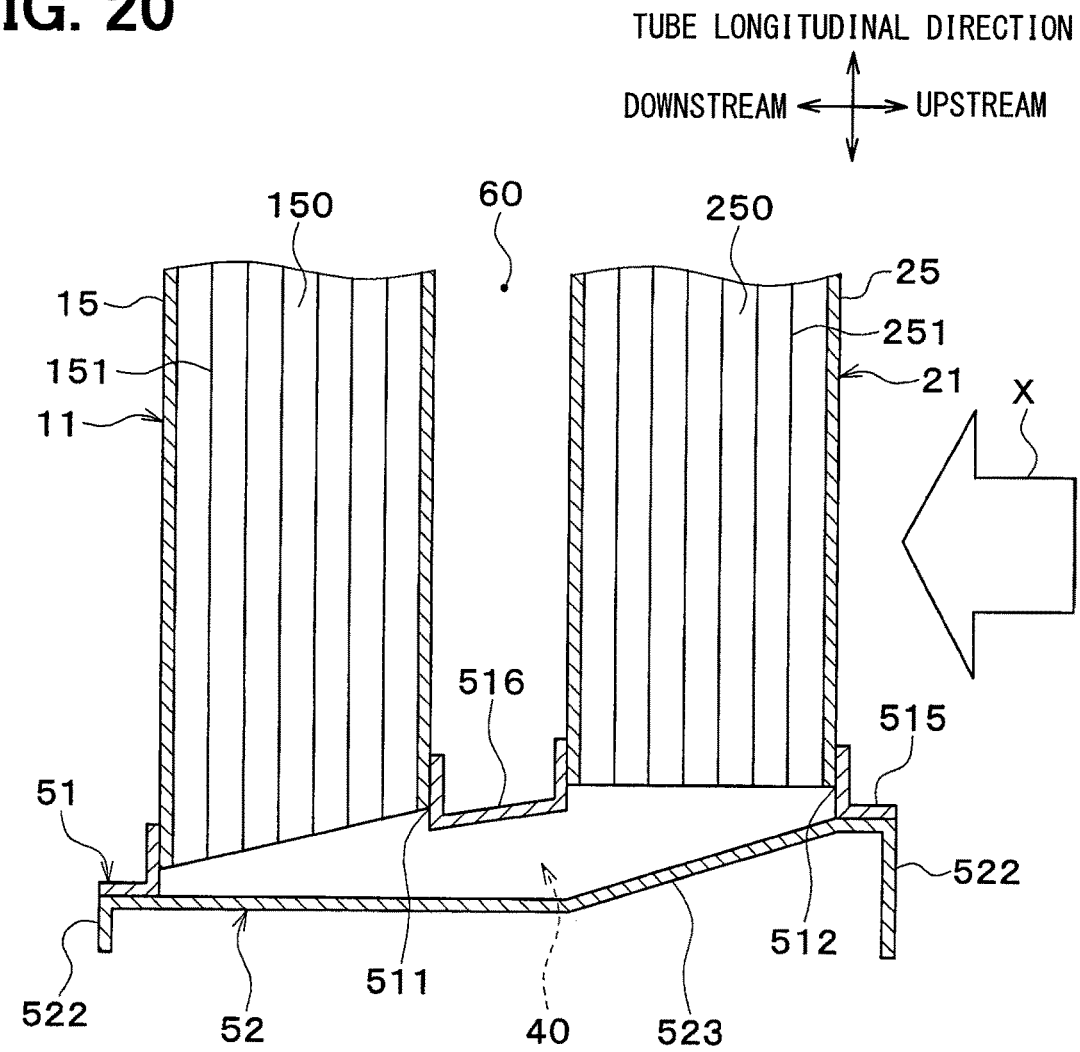
FIG. 20 is an enlarged sectional view of an intermediate tank and its vicinity in a sixth embodiment.
Figure 21:
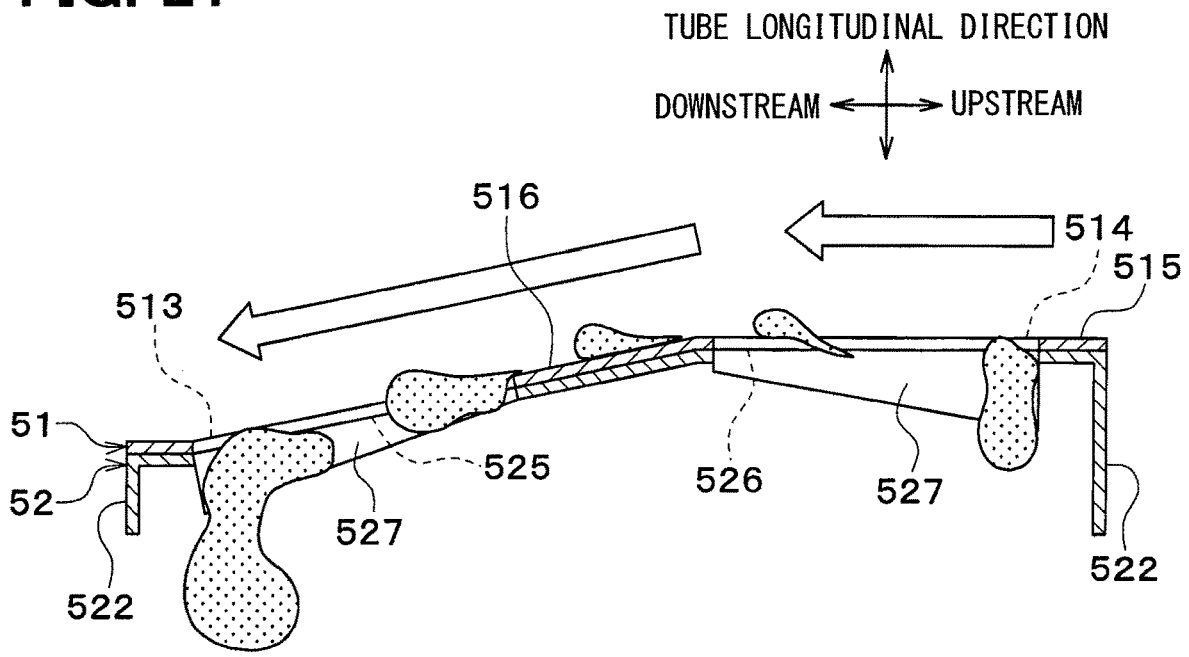
FIG. 21 is a diagram for describing condensate water on the intermediate tank in the sixth embodiment.

As illustrated in FIGS. 20 and 21, a first plate 51 according to the present embodiment includes a level surface 515 and a sloping surface 516. The level surface 515 is a surface straight to the tube longitudinal direction, extending in a horizontal direction. The level surface 515 has second insertion holes 512.

The sloping surface 516 gradually slopes downward toward the airflow downstream side. The sloping surface 516 has first insertion holes 511. The sloping surface 516 is connected to a portion on the airflow downstream side of the level surface 515. The level surface 515 and the sloping surface 516 are integral with each another.

In the present embodiment, the sloping surface 516 gradually sloping downward toward the airflow downstream side is included in a portion on the airflow downstream side of the first plate 51, thus capable of further improving draining of condensate water.

OTHER EMBODIMENTS

The present disclosure is not limited to the foregoing embodiments and can be modified in various manners within the scope of the present disclosure without departing from the spirit of the present disclosure, as in examples described below.

Furthermore, technical features disclosed in the foregoing embodiments may be combined as appropriate within a scope implementable.

(1) While the intermediate tank 50 is placed on the one end side in the tube longitudinal direction (the lower end side) of the cores 11 and 21 in the embodiments described above, the placement of the intermediate tank 50 is not limited to this example. In another example, an intermediate tank 50 may be placed on the other end side in the tube longitudinal direction (the upper end side) of the cores 11 and 21.

Figure 22:
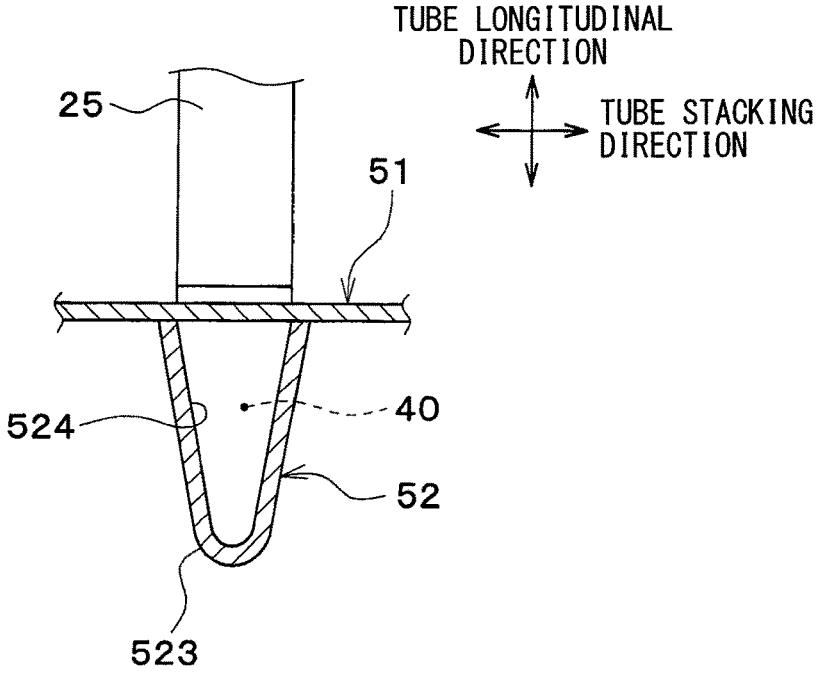
FIG. 22 is an enlarged sectional view of an intermediate tank and its vicinity in another embodiment (2).

(2) While the rib 523 has a substantially U-shaped section when viewed from the airflow direction X in the embodiments described above, the shape of the rib 523 is not limited to this example. In another example, a rib 523 may have a substantially V-shaped section when viewed from the airflow direction X, as illustrated in FIG. 22.

(3) While the fin 30 is joined to both of the tubes 15 and 25 in a pair in the embodiments described above, the placement of the fin 30 is not limited to this example. In another example, a fin 30 joined to adjacent ones of first tubes 15 in the tube stacking direction may be provided separately from a fin 30 joined to adjacent ones of second tubes 25 in the tube stacking direction.

(4) While the intermediate tank 50 in the third embodiment described above includes the intermediate passageways 40 that vary in the area of the passageway in a manner dependent on the air velocity distribution, the configuration of the intermediate tank 50 is not limited to this example.

In another example, the intermediate tank 50 may include intermediate passageways 40 that vary in the area of the passageway in a manner dependent on an air temperature distribution (a humidity distribution). Specifically, an intermediate passageway 40 in a location subjected to higher air temperature (humidity) may have a larger area of the passageway.

(5) While the bent portions 527 are provided in the outer perimeter portions of the third drain holes 525 and the fourth drain holes 526 of the second plate 52 in the fifth and sixth embodiments described above, the configurations of the third drain holes 525 and the fourth drain holes 526 are not limited to this example. In another example, no bent portions 527 may be provided in the outer perimeter portions of the third drain holes 525 or the fourth drain holes 526.

The invention claimed is:

1. A refrigerant evaporator for heat exchange between a fluid and a refrigerant, the refrigerant evaporator comprising:

a first core including a plurality of first tubes through which the refrigerant flows and configured to allow the fluid to flow therethrough in a flow direction, the first core having a first end portion at one end in a tube longitudinal direction, the plurality of first tubes extending along the tube longitudinal direction and stacked in a tube stacking direction, each of the plurality of first tubes having a first end portion at one end in the tube longitudinal direction, the tube longitudinal direction being perpendicular to the flow direction, and the tube stacking direction being perpendicular to both the flow direction and the tube longitudinal direction;

a second core including a plurality of second tubes through which the refrigerant flows and configured to allow the fluid to flow therethrough in the flow direction, the second core arranged in series with the first core in the flow direction, the second core having a first end portion at one end in the tube longitudinal direction, the plurality of second tubes extending along the tube longitudinal direction and stacked in the tube stacking direction, and each of the plurality of second tubes having a first end portion at one end in the tube longitudinal direction;

a first plate connected to both the first end portion of the first core and the first end portion of the second core, and the first plate housing the first end portions of the plurality of first tubes and the first end portions of the plurality of second tubes; and a second plate facing the first core and the second core across the first plate and joined to the first plate in the tube longitudinal direction, wherein the second plate includes a plurality of ribs protruding from the second plate along the tube longitudinal direction away from the first core and the second core and extending along the flow direction, the plurality of ribs define, together with the first plate, a plurality of intermediate passageways therein, each of the plurality of first tubes is arranged to overlap with a respective one of the plurality of second tubes when viewed along the flow direction to form a pair of tubes facing each other along the flow direction, wherein each of the plurality of intermediate passageways is configured to allow the refrigerant having flowed out of a corresponding one of the plurality of first tubes to flow into a corresponding one of the plurality of second tubes, each of the plurality of first tubes has an inner space divided into a plurality of first narrowed passageways, the plurality of first narrowed passageways are arranged in the flow direction, the plurality of first narrowed passageways are formed of a $1^{st}$ narrowed passageway to an $n^{th}$ narrowed passageway that are arranged sequentially toward the plurality of second tubes, where n is a natural number, the $n^{th}$ narrowed passageway has a cross-sectional area denoted as $S_n$, each of the plurality of intermediate passageways includes a portion with a cross-sectional area denoted as $M_n$, through which the refrigerant that has just flowed out of the $n^{th}$ narrowed passageway flows, and each of the plurality of intermediate passageways is configured to satisfy $$0.3\sum_{i=1}^{k} S_i < M_k < 3.0\sum_{i=1}^{k} S_i$$

where k is a natural number less than or equal to n.

2. The refrigerant evaporator according to claim 1, wherein each of the plurality of intermediate passageways is configured to satisfy $$0.5\sum_{i=1}^{k} S_i < M_k < 2.0\sum_{i=1}^{k} S_i$$

where k is a natural number less than or equal to n.

3. The refrigerant evaporator according to claim 1, wherein the first core is disposed downstream of the second core in the flow direction, the plurality of intermediate passageways are configured to allow the refrigerant having flowed out of the plurality of first tubes to flow into the plurality of second tubes, each of the plurality of second tubes has an inner space divided into a plurality of second narrowed passageways arranged in the flow direction, and a most downstream portion of each of the plurality of intermediate passageways in the flow direction has a cross-sectional area that is set to 0.3 times to 3.0 times a cross-sectional area of each of the plurality of first narrowed passageways or a a cross-sectional area of each of the plurality of second narrowed passageways.

4. The refrigerant evaporator according to claim 1, wherein the first core is disposed downstream of the second core in the flow direction, the plurality of intermediate passageways are configured to allow the refrigerant having flowed out of the plurality of first tubes to flow into the plurality of second tubes, each of the plurality of second tubes has an inner space divided into a plurality of second narrowed passageways arranged in the flow direction, and a most upstream portion of each of the plurality of intermediate passageways in the flow direction has cross-sectional area that is set to 0.3 times to 3.0 times a cross-sectional area of the each of the plurality of first narrowed passageways and each of the plurality of second narrowed passageways.

5. The refrigerant evaporator according to claim 1, wherein each of the plurality of intermediate passageways has a U-shaped or V-shaped cross-section when viewed along the flow direction.

6. The refrigerant evaporator according to claim 1, wherein each of the plurality of intermediate passageways is disposed downward of a corresponding one of the pairs of tubes.

7. The refrigerant evaporator according to claim 1, wherein the plurality of intermediate passageways are configured to allow the refrigerant having flowed out of the plurality of first tubes to flow into the plurality of second tubes, the first core is disposed downstream of the second core in the flow direction, and each of the plurality of first tubes has a cross-sectional area smaller than that of each of the plurality of second tubes.

8. The refrigerant evaporator according to claim 1, wherein at least one of the plurality of intermediate passageways has a cross-sectional area different from a cross-sectional area of another of the plurality of intermediate passageways.

9. The refrigerant evaporator according to claim 1, wherein the first core has a second end portion at another end in the tube longitudinal direction, each of the plurality of first tubes has a second end portion at another end in the tube longitudinal direction, the first core includes a first tank connected to the second end portions of the plurality of first tubes for collection or distribution of the refrigerant from or to the plurality of first tubes, the second core has a second end portion at another end in the tube longitudinal direction, each of the plurality of second tubes has a second end portion at another end in the tube longitudinal direction, the second core includes a second tank connected to the second end portions of the plurality of second tubes for collection or distribution of the refrigerant from or to the plurality of second tubes, and the first tank includes:

a partition configured to divide an internal space of the first tank into a first space and a second space that are arranged side by side in the tube stacking direction;

an inflow portion configured to allow the refrigerant to flow into the first space from outside; and an outflow portion configured to allow the refrigerant to flow from the second space to the outside.

10. The refrigerant evaporator according to claim 1, wherein the plurality of intermediate passageways are disposed downward of the pairs of tubes, the first plate defines a through hole that passes through the first plate at a location where the plurality of intermediate passageways are not formed, and the second plate defines a through hole that passes through the second plate at a location where the plurality of intermediate passageways are not formed.

11. The refrigerant evaporator according to claim 10, wherein a bent portion bent downward from the second plate is connected to an outer perimeter portion of the through hole disposed in the second plate.

12. The refrigerant evaporator according to claim 1, wherein a sloping surface sloping downward toward a downstream side of the flow direction is formed in a downstream side portion of the first plate in the flow direction.

13. A method for manufacturing the refrigerant evaporator according to claim 1, the method comprising:

forming through apertures into which the plurality of first tubes and the plurality of second tubes are to be inserted by performing roll-forming on a first elongated thin plate using a first roll die;

cutting the first elongated thin plate having the through apertures to a predefined first reference length to form the first plate;

forming the plurality of ribs by performing roll-forming on a second elongated thin plate using a second roll die;

cutting the second elongated thin plate having the plurality of ribs to a predefined second reference length to form the second plate;

temporarily securing the plurality of first tubes and the plurality of second tubes to the first plate and the second plate; and heating and brazing, in a heating furnace, a temporary assembly formed of the first tubes, the second tubes, the first plate, and the second plate that are temporarily secured to each other.

* * * * *